US005441653A

United States Patent [19]

Cleveland et al.

[11] Patent Number: 5,441,653

[45] Date of Patent: Aug. 15, 1995

[54] TWO-STROKE CYCLE ENGINE LUBRICANT AND METHOD OF USING SAME

[75] Inventors: William K. S. Cleveland, Mentor on the Lake; Paul E. Adams, Willoughby Hills; Marvin B. De Tar, Wickliffe, all of Ohio

[73] Assignee: The Lubrizol Corporation, Wickliffe, Ohio

[21] Appl. No.: 287,996

[22] Filed: Aug. 9, 1994

[51] Int. Cl.[6] ..... C10M 129/38; C10M 129/40; C10L 1/18; C10L 1/22

[52] U.S. Cl. ..... 252/34; 252/51.005 A; 252/51.005 R; 252/48.006; 252/57; 252/56 R; 44/389; 44/390; 44/391; 44/403; 44/405; 44/408; 44/418; 44/419

[58] Field of Search ..... 252/51.5 A, 56 R, 48.6, 252/51.5 R, 57, 34; 44/389, 390, 391, 403, 405, 408, 418, 419

[56] References Cited

U.S. PATENT DOCUMENTS

| | | | |
|---|---|---|---|
| 2,933,520 | 4/1960 | Bader . | |
| 2,984,685 | 5/1961 | Holmen . | |
| 3,282,939 | 11/1966 | Spivack et al. . | |
| 3,338,833 | 8/1967 | Spivack et al. . | |
| 3,360,464 | 12/1967 | Otto, Jr. . | |
| 3,954,808 | 5/1976 | Elliott et al. . | |
| 3,966,807 | 6/1976 | Elliott et al. . | |
| 4,046,802 | 9/1977 | Elliott et al. . | |
| 4,051,049 | 9/1977 | Elliott et al. . | |
| 4,083,791 | 4/1978 | Elliott et al. . | |
| 4,108,784 | 8/1978 | Bryant et al. . | |
| 4,194,886 | 3/1980 | Ripple . | |
| 4,205,960 | 6/1980 | Bryant . | |
| 4,234,435 | 11/1980 | Meinhardt et al. . | |
| 4,285,824 | 8/1981 | Bryant . | |
| 4,425,138 | 1/1984 | Davis . | |
| 4,534,874 | 8/1985 | Steinberg et al. . | |
| 4,663,063 | 5/1987 | Davis . | |
| 4,708,809 | 11/1987 | Davis . | |
| 4,740,321 | 4/1988 | Davis et al. . | |
| 5,281,346 | 1/1994 | Adams et al. . | |
| 5,336,278 | 8/1994 | Adams et al. . | |
| 5,393,441 | 2/1995 | Thaler et al. | 252/51.005 A |
| 5,395,539 | 3/1995 | Chandler et al. | 252/51.005 A |

FOREIGN PATENT DOCUMENTS

| | | |
|---|---|---|
| 2048211 | 2/1992 | Canada . |
| 0331556 | 9/1989 | France . |

OTHER PUBLICATIONS

Derwent Abstract 89-257868/36.

*Primary Examiner*—Jacqueline V. Howard

*Attorney, Agent, or Firm*—Joseph P. Fischer; Frederick D. Hunter; James L. Cordek

[57] ABSTRACT

Two-stroke cycle engine lubricant and lubricant fuel composition comprise a composition prepared by reacting an aromatic compound of the formula

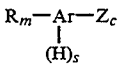

(I)

with a carboxylic reactant $R^1CO(CR^2R^3)_xCOOR^{10}$ and optionally, ammonia or amines.

In another embodiment the 2-stroke cycle lubricants contain a carboxylic composition of the formula

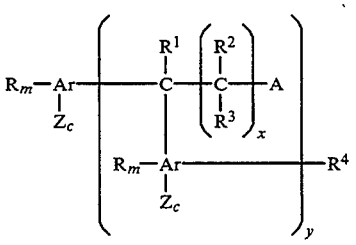

(III)

wherein the various groups are defined herein.

110 Claims, No Drawings

TWO-STROKE CYCLE ENGINE LUBRICANT AND METHOD OF USING SAME

FIELD OF THE INVENTION

This invention relates to lubricant compositions and fuel-lubricant mixtures useful in two-stroke cycle engines. More particularly, it relates to lubricant compositions containing a major amount of an oil of lubricating viscosity and a minor amount of at least one carboxylic composition as described in greater detail hereinbelow.

BACKGROUND OF THE INVENTION

Over the past several decades the use of spark-ignited two-stroke cycle (two-cycle, 2-stroke) internal combustion engines has steadily increased. They are presently found in power lawn mowers and other power-operated garden equipment, power chain saws, pumps, electrical generators, marine outboard engines, snowmobiles, motorcycles and the like. These engines may be air-cooled or water-cooled. Two-stroke cycle engines have found limited application as automobile and truck engines. Manufacturers are exploring how to expand this use.

The increasing use of two-stroke cycle engines coupled with increasing severity of the conditions under which they are operated has led to an increased demand for oils to not only adequately lubricate such engines but also provide enhanced performance. Among the problems associated with two-stroke cycle engines are piston ring sticking, piston scuffing, rusting, lubrication related failure of connecting rod and main bearings and general formation of carbon and varnish deposits on the engine's interior surfaces. Piston ring sticking is a particularly serious problem. Ring sticking leads to failure of the sealing function of piston rings. Such sealing failure causes loss of cylinder compression which is particularly damaging in two-stroke cycle engines because many of these engines depend on suction to draw the new fuel charge into the exhausted cylinder. Thus, ring sticking can lead to deterioration of engine performance and unnecessary consumption of fuel and/or lubricant. Other problems associated with two-stroke cycle engines include piston lubricity, scuffing or scoring.

All of the aforementioned problems associated with two-stroke cycle engines must be adequately addressed. Improved performance is continually being sought. The unique problems and techniques associated with the lubrication of two-cycle engines has led to the recognition by those skilled in the art of two-cycle engine lubricants as a distinct lubricant type. See, for example, U.S. Pat. Nos. 3,085,975; 3,004,837; and 3,753,905.

The compositions of the present invention are effective in controlling the aforementioned problems.

While color, per se, is not often a consideration when evaluating performance of a 2-cycle engine lubricant, it may be a consideration for other reasons.

As is well-known, the equipment operator frequently prepares lubricant-fuel blends. A particularly dark colored lubricant or one that imparts a significant color to the lubricant-fuel blend, while not affecting performance, may be considered objectionable. Furthermore, two-stroke cycle oils frequently contain a small amount of dye, to impart a characteristic color to the lubricant-fuel blend. If the color of the lubricant is pronounced, it may mask the color of the dyed fuel or may lead the user to believe that the lubricant-fuel blend has deteriorated.

The lubricating compositions of the instant invention are considerably lighter in color than many commercially available lubricants.

U.S. Pat. No. 4,425,138 relates to amino phenols used in lubricant fuel mixtures for two-cycle engines. U.S. Pat. Nos. 4,663,063 and 4,724,091 issued to Davis relate to a combination of an alkyl phenol and an amino compound in two-cycle engines.

U.S. Pat. Nos. 4,708,809 and 4,740,321 relate to use of alkylated phenols in two-cycle engine lubricants. U.S. Pat. No. 4,231,757 relates to nitrophenol-amine condensates and the use thereof in two cycle oils.

U.S. Pat. No. 5,281,346 relates to two-cycle engine lubricants and fuel-lubricant mixtures comprising metal bis-phenol carboxylates.

Applicants' assignee's co-pending U.S. application Ser. No. 08/061,377 relates to amide and amide-containing derivatives of bis-phenol carboxylic compounds and their use in fuels other than two-cycle fuels.

U.S. Pat. No. 3,954,808 relates to bis (phenol substituted) alkanoic acid compounds as intermediates in preparation of lubricant additives. U.S. Pat. No. 3,966,807 describes amides of bis (phenol substituted) carboxylic acids as lubricating oil additives.

SUMMARY OF THE INVENTION

This invention relates to lubricants for two-stroke cycle engines comprising a major amount of at least one oil of lubricating viscosity and a minor amount of at least one carboxylic composition prepared by reacting (a) at least one reactant of the formula $$R_m-\underset{\underset{(H)_s}{|}}{Ar}-Z_c \qquad (I)$$

wherein R is a hydrocarbyl group, m ranges from 0 to about 6, Ar is an aromatic group containing from 5 to about 30 carbon atoms and having from 0 to 3 optional substituents selected from the group consisting of polyalkoxyalkyl, lower alkoxy, nitro or combinations of two or more of said optional substituents, wherein s is a number of at least 1, each Z is independently OH or $(OR^5)_bOH$, wherein $R^5$ is independently a divalent hydrocarbyl group and b is a number ranging from 1 to about 30 and c is a number ranging from 1 to about 3, wherein the sum s+m+c does not exceed the number of valences of Ar available for substitution, and (b) a carboxylic reactant of the formula $$R^1CO(CR^2R^3)_xCOOR^{10}$$

wherein each of $R^1$, $R^2$ and $R^3$ is independently H or a hydrocarbyl group, $R^{10}$is H or an alkyl group and x is a number ranging from 0 to about 8; and optionally, (c) ammonia or an amine having at least one N—H group.

In another embodiment, this invention is directed to two-stroke cycle engine lubricant compositions comprising a major amount of an oil of lubricating viscosity and a minor amount of at least one carboxylic composition of the general formula (III)

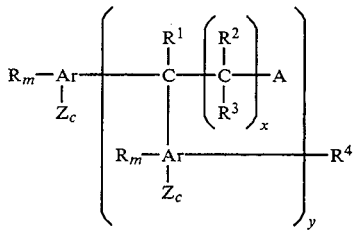

wherein each Ar is independently an aromatic group having :from 5 to about 30 carbon atoms and from about 0 to 3 optional substituents selected from the group consisting of amino, hydroxy- or alkylpolyoxyalkyl, nitro, aminoalkyl, carboxy, or combinations of two or more of said optional substituents, each R is independently a hydrocarbyl group, $R^1$ is H or a hydrocarbyl group, $R^4$ is selected from the group consisting of H, a hydrocarbyl group, a member of the group of optional substituents on Ar, or lower alkoxy, each m is independently 0 or an integer ranging from 1 to about 6, x ranges from 0 to about 8, and each Z is independently OH, lower alkoxy or $(OR^5)_bOR^6$, wherein each $R^5$ is independently a divalent hydrocarbyl group, $R^6$ is H or hydrocarbyl and b is a number ranging from 1 to about 30, and c ranges from 1 to about 3, y is a number ranging from 1 to about 10 and wherein the sum m+c does not exceed the number of valences of the corresponding Ar available for substitution, and each A is independently a carboxylic group selected from the group consisting of an amide or amide-containing group, a carboxyl group, a group of the formula

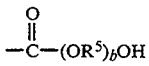

wherein each $R^5$ is independently a divalent hydrocarbyl group and b is a number ranging from 1 to about 30, an imidazoline-containing group, an oxazoline group, an ester group, an acylamino group or one Z and one A are taken together, make up a group of the formula

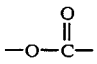

to form a lactone group of the formula (IV)

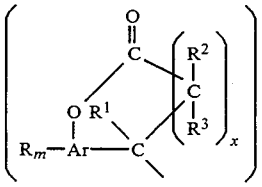

or mixtures thereof.

Since lubricant compositions for two-stroke cycle engines are often mixed with fuels before or during combustion, this invention also includes fuel-lubricant mixtures. Also included within the scope of this invention are methods for operating two-stroke cycle engines employing the lubricants and lubricant-fuel mixtures of this invention.

Therefore, it is an object of this invention to provide novel lubricants and fuel-lubricant mixtures for two-stroke cycle engines. Another object is to provide improved lubricants and fuel-lubricant mixtures for two-stroke cycle engines.

It is a further object of this invention to provide novel means for lubricating two-stroke cycle engines.

Other objects will be apparent to those skilled in the art upon review of the present specification.

DESCRIPTION OF THE PREFERRED EMBODIMENTS

Detailed Description of the Invention

As mentioned hereinabove, the compositions of this invention, are two-stroke cycle engine lubricants comprising a major amount of an oil of lubricating viscosity and a minor amount of at least one carboxylic compound represented by general formula (III) or, in another embodiment, comprising a carboxylic compound prepared by reacting at least one reactant of the formula

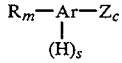

(I)

with a carboxylic reactant of the formula $R^1CO(CR^2R^3)_xCOOR^{10}$, and optionally with ammonia or an amine.

Specific features and embodiments are discussed in detail hereinbelow.

The Aromatic Moiety Ar

The group Ar is an aromatic group containing from 5 to about 30 carbon atoms and from 0 to 3 optional substituents selected from the group consisting of amino, hydroxy- or alkyl-polyoxyalkyl, nitro, carboxy or combinations of two or more of said optional substituents.

The aromatic group Ar can be a single aromatic nucleus such as a benzene nucleus, a pyridine nucleus, a 1,2,3,4-tetrahydronaphthalene nucleus, etc., or a polynuclear aromatic moiety. Polynuclear moieties can be of the fused type; that is, wherein at least one aromatic nucleus is fused at two points to another nucleus as in naphthalene, anthracene, the azanaphthalenes, etc. Alternatively, such polynuclear aromatic moieties can be of the linked type wherein at least two nuclei (either mono- or polynuclear) are linked through bridging linkages to each other. Such bridging linkages can be chosen from the group consisting of carbon-to-carbon single bonds, ether linkages, carbonyl group containing linkages, sulfide linkages, polysulfide linkages of 2 to 6 sulfur atoms, sulfinyl linkages, sulfonyl linkages, methylene linkages, alkylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages. In certain instances, more than one bridging linkage can be present in Ar between aromatic nuclei. For example, a fluorene nucleus has two benzene nuclei linked by one methylene linkage and one covalent bond. Such a nucleus may be considered to have 3 nuclei but only two of them are aromatic. More often, Ar will contain only carbon atoms in the aromatic nucleus per se. When Ar contains only carbon atoms in the aromatic nucleus, it will contain at least 6 carbon atoms.

Specific examples of single ring Ar moieties are

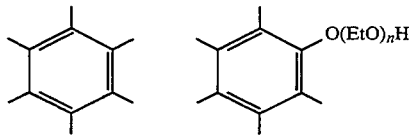

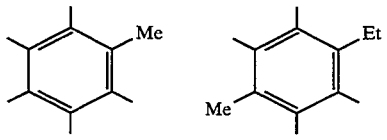

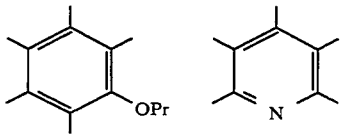

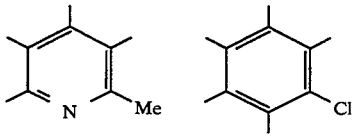

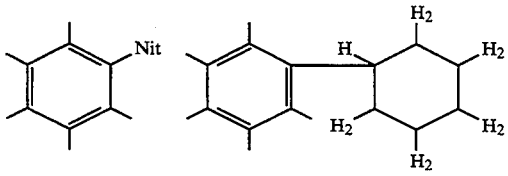

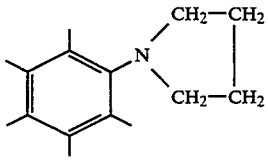

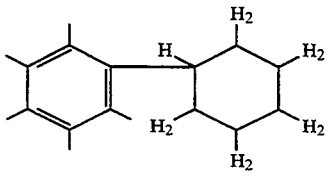

etc., wherein Me is methyl, Et is ethyl or ethylene, as appropriate, Pr is n-propyl, and Nit is nitro.

Specific examples of fused ring aromatic moieties Ar are:

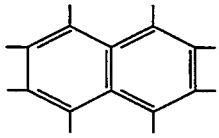

-continued

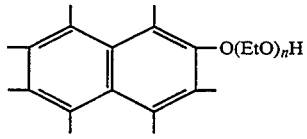

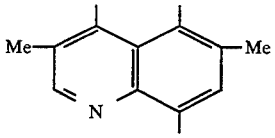

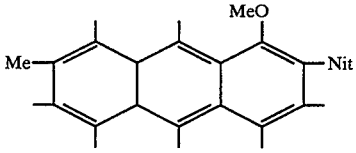

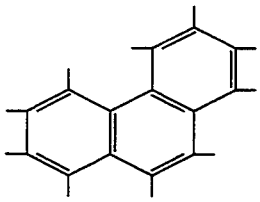

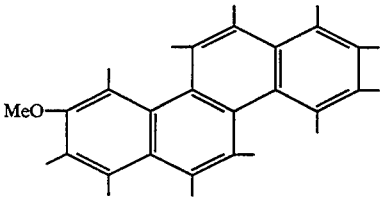

etc.

When the aromatic moiety Ar is a linked polynuclear aromatic moiety, it can be represented by the general formula $$ar\text{-}(L\text{-}ar)_w$$

wherein w is an integer of 1 to about 6, each ar is a single ring or a fused ring aromatic nucleus of 5 to about 1.2 carbon atoms and each L is independently selected from the group consisting of carbon-to-carbon single bonds between ar nuclei, ether linkage (e.g. —O—) keto linkages (e.g., $$-\overset{\overset{O}{\|}}{C}-),$$

sulfide linkages (e.g. —S—), polysulfide linkages (e.g., $-S-_{2\text{-}6}$), sulfinyl linkages (e.g., —S(O)—), sulfonyl linkages (e.g., $-S(O)_2-$), lower alkylene linkages (e.g., $-CH_2-$, $-CH_2-CH_2-$, $-CR^o{}_2-$, $$-\underset{\underset{R^o}{|}}{CH}-CH-),$$

lower alkylene ether linkages (e.g., $—CH_2—$, $—CH_2O—CH_2—$, $—CH_2—CH_2O—$, $—CH_2CH_2OCH_2CH_2—$, $$—CH_2\underset{R^o}{\underset{|}{C}}HO\underset{R^o}{\underset{|}{C}}H_2CH—, \quad —CH_2\underset{R^o}{\underset{|}{C}}HO\underset{R^o}{\underset{|}{C}}HCH_2—,$$

lower alkylene sulfide linkages (e.g., wherein one or more —O—'s in the lower alkylene ether linkages is replaced with a S atom), lower alkylene polysulfide linkages (e.g., wherein one or more —O— is replaced with a $—S—_{2-6}$ group), amino linkages (e.g.

$$—\underset{H}{\underset{|}{N}}—, \quad —\underset{R^o}{\underset{|}{N}}—,$$

$—CH_2N—$, $—CH_2NCH_2—$, —alk—N—, where alk is lower alkylene, etc.), polyamino linkages (e.g., $—N(alkN)_{1-10}$, where the unsatisfied free N valences are taken up with H atoms or $R^o$ groups), linkages having the formula

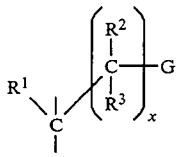

(II)

wherein each of $R^1$, $R^2$ and $R^3$ is independently H or hydrocarbyl preferably H or alkyl or alkenyl, most preferably lower alkyl or H, each G is independently an amide or an amide-containing group, a carboxyl group, an ester group, an oxazoline-containing group or an imidazoline-containing group and x is an integer ranging from 0 to about 8, and mixtures of such bridging linkages (each $R^o$ being a lower alkyl group).

Specific examples of linked moieties are:

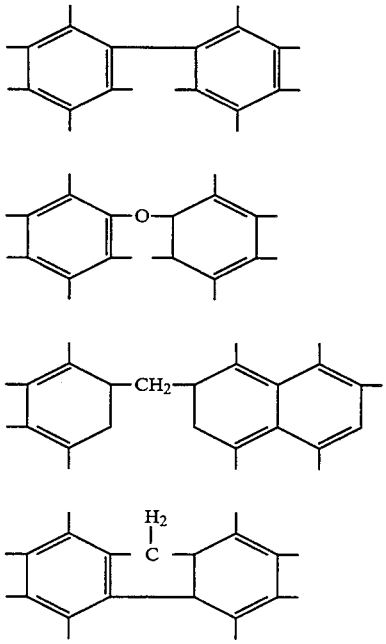

-continued

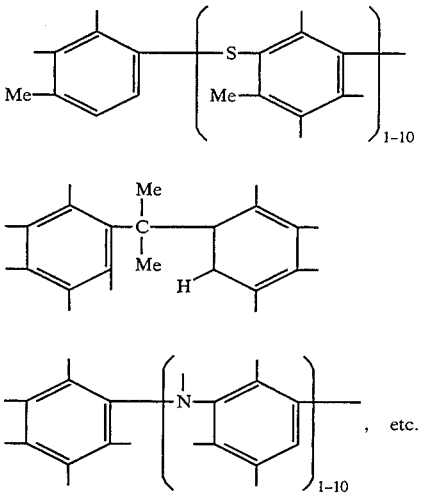

, etc.

Usually all of these Ar groups have no substituents except for the R and Z groups (and any bridging groups).

For such reasons as cost, availability, performance, etc., Ar is normally a benzene nucleus, a lower alkylene bridged benzene nucleus, or a naphthalene nucleus. Most preferably, Ar is a benzene nucleus.

The Group R

The compounds of formula (I) and (III) employed in the present invention preferably contain, directly bonded to at least one aromatic group Ar, at least one group R which., independently, is a hydrocarbyl group. More than one hydrocarbyl group can be present, but usually no more than 2 or 3 hydrocarbyl groups are present for each aromatic nucleus in the aromatic group.

The number of R groups on each. Ar group is indicated by the subscript m. For the purposes of this invention, each m may be independently 0 or an integer ranging from 1 up to about 6 with the proviso that m does not exceed the number of valences of the corresponding Ar available for substitution. Frequently, each m is independently an integer ranging from. 1 to about 3. In an especially preferred embodiment each m equals 1.

Each R frequently contains up to about 750 carbon atoms, more frequently from 4 to about 750 carbon atoms, preferably from 4 to about 400 carbon atoms and more preferably from. 4 to about 100 carbons. R is preferably an aliphatic group, more preferably alkyl or alkenyl, preferably alkyl or substantially saturated alkenyl. In one preferred embodiment, R is aliphatic and contains at least about 6 carbon atoms, often from. 8 to about 100 carbons. In another embodiment, each R contains an average of at least about 30 carbon atoms, often an average of from about 30 to about 100 carbons. In another embodiment, R is aliphatic and contains from 12 to about 50 carbon atoms. In a further embodiment, R is aliphatic and contains from about 7 to about 28 carbon atoms, preferably from 1.2 to about 24 carbon atoms and more preferably from 12 to about 18 carbon atoms. In another preferred embodiment, R contains from about 16 to about 28 carbon atoms. In one embodiment, at least one R is derived from an alkane or alkene having number average molecular weight ranging from about 300 to about 800. In another embodiment, R is aliphatic and contains an average of at least about 50 carbon atoms.

In one preferred embodiment m is 2, each Ar contains at least one tertiary-butyl group, and the other R group contains from 4 to about 100 carbon atoms, for example a 2,4-di-t-butyl phenol.

When the group R is an alkyl or alkenyl group having from 2 to about 28 carbon atoms, it is typically derived from the corresponding olefin; for example, a butyl group is derived from butene, an octyl group is derived from octene, etc. When R is a hydrocarbyl group having at least about 30 carbon atoms, it is frequently an aliphatic group, preferably an alkyl or alkenyl group, made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-olefins such as homopolymers of ethylene. These aliphatic hydrocarbyl groups may also be derived from halogenated (e.g., chlorinated or brominated) analogs of such homo- or interpolymers. R groups can, however, be derived from other sources, such as monomeric high molecular weight alkenes (e.g., 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly(ethylene) greases) and other sources known to those skilled in the art. Any unsaturation in the R groups may be reduced or eliminated by hydrogenation according to procedures known in the art.

In one preferred embodiment, at least one R is derived from polybutene. In another preferred embodiment, R is derived from polypropylene.

As used herein, the term "hydrocarbyl or hydrocarbyl group" denotes a group having a carbon atom directly attached to the remainder of the molecule and having predominantly hydrocarbon character within the context of this invention. Thus, the term "hydrocarbyl" includes hydrocarbon, as well as substantially hydrocarbon, groups. Substantially hydrocarbon describes groups, including hydrocarbon based groups, which contain non-hydrocarbon substituents, or non-carbon atoms in a ring or chain, which do not significantly alter the predominantly hydrocarbon nature of the group.

Hydrocarbyl groups can contain up to three, preferably up to two, more preferably up to one, non-hydrocarbon substituent, or non-carbon heteroatom in a ring or chain, for every ten carbon atoms provided this non-hydrocarbon substituent or non-carbon heteroatom does not significantly alter the predominantly hydrocarbon character of the group. Those skilled in the art will be aware of such heteroatoms, such as oxygen, sulfur and nitrogen, or substituents, which include, for example, hydroxyl, alkoxyl, alkyl mercapto, alkyl sulfoxy, etc.

Examples of hydrocarbyl groups include, but are not necessarily limited to, the following:

(1) hydrocarbon groups, that is, aliphatic (e.g., alkyl or alkenyl), alicyclic (e.g., cycloalkyl, cycloalkenyl) groups, aromatic groups (e.g., phenyl, naphthyl), aromatic-, aliphatic- and alicyclic- substituted aromatic groups and the like as well as cyclic groups wherein the ring is completed through another portion of the molecule (that is, for example, any two indicated groups may together form an alicyclic radical);

(2) substituted hydrocarbon groups, that is, those groups containing non-hydrocarbon-containing substituents which, in the context of this invention, do not significantly alter the predominantly hydrocarbon character; those skilled in the art will be aware of such groups (e.g., hydroxy, alkoxy, mercapto, alkylmercapto, nitro, nitroso, sulfoxy, etc.);

(3) hetero groups, that is, groups which will, while having a predominantly hydrocarbon character within the context of this invention, contain atoms other than carbon present in a ring or chain otherwise composed of carbon atoms. Suitable heteroatoms will be apparent to those of ordinary skill in the art and include, liar example, sulfur, oxygen, nitrogen. Such groups as, e.g., pyridyl, furyl, thienyl, imidazolyl, etc. are representative of heteroatom containing cyclic groups.

Typically, no more than about two, preferably no more than one, non-hydrocarbon substituent or non-carbon atom in a chain or ring will be present for every ten carbon atoms in the hydrocarbyl group.

Usually the hydrocarbyl groups are purely hydrocarbon and contain substantially no non-hydrocarbon groups, substituents or heteroatoms.

Preferably, hydrocarbyl groups R are substantially saturated. By substantially saturated it is meant that the group contains no more than one carbon-to-carbon unsaturated bond, olefinic unsaturation, for every ten carbon-to-carbon bonds present. Usually, they contain no more than one carbon-to-carbon non-aromatic unsaturated bond for every 50 carbon-to-carbon bonds present. In one especially preferred embodiment, the hydrocarbyl group R is substantially free of carbon to carbon unsaturation. It is to be understood that, within the context of this invention, aromatic unsaturation is not normally considered to be olefinic unsaturation. That is, aromatic groups are not considered as having carbon-to-carbon unsaturated bonds.

Preferably, hydrocarbyl groups R are substantially aliphatic in nature, that is, they contain no more than one non-aliphatic (cycloalkyl., cycloalkenyl or aromatic) group for every 10 carbon atoms in the R group. Usually, however, the R groups contain no more than one such non-aliphatic group for every 50 carbon atoms, and in many cases, they contain no such non-aliphatic groups; that is, the typical R group is purely aliphatic. These purely aliphatic R groups are alkyl or alkenyl groups.

Specific non-limiting examples of substantially saturated hydrocarbyl R groups are: methyl, tetra (propylene), nonyl, triisobutyl, oleyl, tetracontanyl, henpentacontanyl, a mixture of poly(ethylene/propylene) groups of about 35 to about 70 carbon atoms, a mixture of the oxidatively or mechanically degraded poly(ethylene/propylene) groups of about 35 to about 70 carbon atoms, a mixture of poly (propylene/1-hexene) groups of about 80 to about 150 carbon atoms, a mixture of poly(isobutene) groups having between 20 and 32 carbon atoms, and a mixture of poly(isobutene) groups having an average of 50 to 75 carbon atoms. A preferred source of hydrocarbyl groups R are polybutenes obtained by polymerization of a C4 refinery stream having a butene content of 35 to 75 weight percent and isobutene content of 15 to 60 weight percent in the presence of a Lewis acid catalyst such as aluminum trichloride or boron trifluoride. These polybutenes contain predominantly (greater than 80% of total repeating units) isobutene repeating units of the configuration

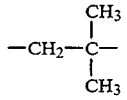

These polybutenes are typically monoolefinic. In one embodiment, the monoolefinic groups are vinylidene groups, i.e., groups of the formula $CH_2{=}C<$ although the polybutenes may also comprise other olefinic configurations.

In one embodiment the polybutene is substantially monoolefinic, comprising at least about 50% vinylidene groups, more preferably at least about 80% vinylidene groups.

Such polybutenes are described in U.S. Pat. No. 5,254,643, which is hereby expressly incorporated herein by reference.

The attachment of a hydrocarbyl group R to the aromatic moiety Ar of the compounds of formula (I) of this invention can be accomplished by a number of techniques well known to those skilled in the art. One particularly suitable technique is the Friedel-Crafts reaction, wherein an olefin (e.g., a polymer containing an olefinic bond), or halogenated or hydrohalogenated analog thereof, is reacted with a phenol in the presence of a Lewis acid catalyst. Methods and conditions for carrying out such reactions are well known to those skilled in the art. Another technique involves the use of a strong acid catalyst. Included among such catalysts are the Amberlyst® ion exchange resins supplied by Rohm & Haas Company. See, for example, the discussion in the article entitled, "Alkylation of Phenols" in "Kirk-Othmer Encyclopedia of Chemical Technology", Third Edition, Vol. 2, pages 65–66, Interscience Publishers, a division of John Wiley and Company, N.Y., and U.S. Pat. Nos. 4,379,065; 4,663,063; and 4,708,809, all of which are expressly incorporated herein by reference for relevant disclosures regarding alkylation of aromatic compounds. Other equally appropriate and convenient techniques for attaching the hydrocarbon-based group R to the aromatic moiety Ar will occur readily to those skilled in the art.

The Groups Z

Each Z is independently OH, lower alkoxy, $(OR^5)_bOR^6$, or $O^-$ wherein each $R^5$ is independently a divalent hydrocarbyl group, $R^6$ is H or hydrocarbyl and b is a number ranging from 1 to about 30.

The subscript c indicates the number of Z groups that may be present as substituents on each Ar group. There will be at least one Z group substituent, and there may be more, depending on the value of the subscript m. For the purposes of this invention, c is a number ranging from 1 to about 3. In a preferred embodiment, c is 1.

As mentioned hereinabove and discussed further hereinbelow, one Z and one A may be taken together to make up a group of the formula.

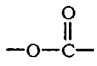

As will be appreciated from the foregoing, the compounds of formula (III) employed in this invention contain at least two Z groups and may contain one or more R groups as defined hereinabove. Each of the foregoing groups must be attached to a carbon atom which is a part of an aromatic nucleus in the Ar group. They need not, however, each be attached to the same aromatic nucleus if more than one aromatic nucleus is present in the Ar group.

As mentioned hereinabove, each Z group may be, independently, OH, lower alkoxy, $O^-$, or $(OR^5)_bOR^6$ as defined hereinabove. In a preferred embodiment, each Z is OH. In another embodiment, each Z may be $O^-$. In another preferred embodiment, at least one Z is OH and at least one Z is $O^-$. Alternatively, at least one Z may be a group of the formula $(OR^5)_bOR^6$, or lower alkoxy. As mentioned hereinabove, each $R^5$ is independently a divalent hydrocarbyl group. Preferably, $R^5$ is an aromatic or an aliphatic divalent hydrocarbyl group. Most preferably, $R^5$ is an alkylene group containing from 2 to about 30 carbon atoms, more preferably from 2 to about 8 carbon atoms and most preferably 2 or 3 carbon atoms. $R^6$ is preferably H or alkyl, more preferably H or lower alkyl, that is, containing from 1 to about 7 carbon atoms.

The subscript b typically ranges from 1 to about 30, preferably from 1 to about 10, and most preferably from 1 or 2 to about 5.

The Groups $R^1$, $R^2$ and $R^3$

Each of the groups $R^1$, $R^2$ and $R^3$ is independently H or a hydrocarbyl group. In one embodiment, each of $R^1$, $R^2$ and $R^3$ is, independently, H or a hydrocarbyl group having from 1 to about 100 carbon atoms, more often from 1 to about 24 carbon atoms. In a preferred embodiment, each of the aforementioned groups is independently hydrogen or alkyl or alkenyl. In one preferred embodiment each of $R^1$, $R^2$ and $R^3$ is, independently, H or lower alkyl. In an especially preferred embodiment, each of the aforementioned groups is H. For the purposes of this invention, the term "lower" when used in the specification and claims to describe an alkyl or alkenyl group means from 1 to 7 carbon atoms.

The Group $R^4$ $R^4$ is a terminating substituent on an Ar group. As such, $R^4$ may be H or any of the groups defined hereinabove as substituents on Ar provided that said substituent is monovalent. Thus, $R^4$ may be any of the optional substituents referred to hereinabove, as well as R, Z or H. Most often, $R^4$ is H or a hydrocarbyl group, preferably H or lower alkyl, or lower alkenyl, most preferably, H.

The subscript y defines the number of

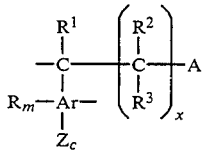

groups present in (III). The number y is at least one, usually a number ranging from 1 to about 10, more often from 1 to about 3, and preferably 1.

The subscript x denotes the number of

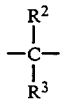

groups present. For the purposes of this invention, x normally ranges from 0 to about 8. In a preferred embodiment, x is 0, 1 or 2. Most preferably x equals 0.

The Group A

The compound of formula (III) contains at least one group A. When y=1, the compound of formula (III) contains one group A. When y is a number greater than 1, the compound of formula (I) contains more than one group A. At least one A is, independently, an amide or amide-containing group, a group of the formula

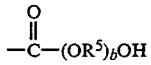

wherein each $R^5$ is independently a divalent hydrocarbyl group and b is a number ranging from 1 to about 30, ester groups, carboxyl groups, acylamino groups, imidazoline-containing groups, oxazoline-containing groups or, one Z and A taken together make up a group of the formula

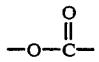

to form a lactone group of the formula

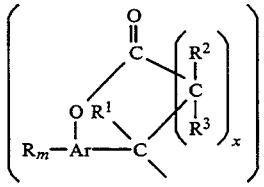

(IV)

Preferably each A is independently an amide or amide-containing group or A and Z, taken together make up a group of the formula

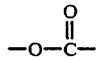

generate the lactone group (IV).

It is to be understood that compounds of formula (III) may comprise mixtures of the contemplated group A.

Within the preferred embodiment wherein A is an amide or amide containing group it is preferred that carboxylic acid groups or lactones comprise no more than about 50% of the total carbonyl group containing functionality. More preferably, no more than about 30% unreacted carboxylic acid groups or lactone, even more preferably, no more than about 15% and even more preferably, no more than about 5% unreacted carboxylic acid or lactone are present. Of course, in the other preferred embodiment, the compound of formula III may comprise essentially 100% lactone or carboxylic acid groups.

In one embodiment, at least one A is an amide group of the formula

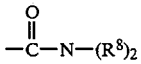

wherein each $R^8$ is independently H, alkoxyalkyl, hydroxyalkyl or a hydrocarbyl group.

In a particular embodiment, both $R^8$ are H.

In another particular embodiment at least one $R^8$ is hydrocarbyl, preferably alkyl, more preferably lower alkyl and the other $R^8$ is H. Especially preferred is where one $R^8$ is methyl, ethyl or propyl and the other $R^8$ is H.

The term "lower" when used to describe hydrocarbyl groups such as alkyl, alkenyl, etc., means containing 7 or fewer carbon atoms.

In one embodiment at least one A has the general formula

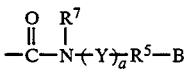

(V)

wherein each Y is a group of the formula

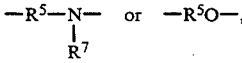

each $R^5$ is a divalent hydrocarbyl group and each $R^7$ is H, alkoxyalkyl, hydroxyalkyl, a hydrocarbyl group, an aminohydrocarbyl group or an N-alkoxyalkyl- or hydroxyalkyl-substituted amino hydrocarbyl group, and B is an amide group, an imide-containing group, an amide-containing group or an acylamino group. The subscript a may be 0 or a number ranging from 1 to about 100. More typically, when Y is a group of the formula

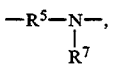

the subscript "a" ranges from 1 to about 10, more often from 1 to about 6. When Y is —$R^5$O—, the subscript a typically ranges from 1 to about 100, preferably from 10 to about 50.

Preferably, each $R^5$ is lower alkylene such as ethylene, propylene or butylene.

The groups B are preferably selected from acylamino groups of the formula

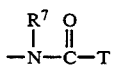

(VI)

wherein each $R^7$ is independently H, alkoxyalkyl, hydroxyalkyl, hydrocarbyl, aminohydrocarbyl or an N-alkoxyalkyl- or N-hydroxyalkyl-substituted amino hydrocarbyl group and T is hydrocarbyl, groups of the formula (VII)

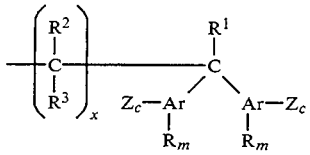

wherein each component of this group is defined hereinabove, or imide-containing groups.

In another embodiment, at least one A has the formula (VIII)

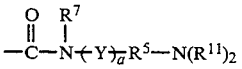

wherein each Y is a group of the formula

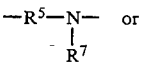

each $R^5$ is independently a divalent hydrocarbyl group, each $R^{11}$ is independently H, alkoxyalkyl, hydroxyalkyl or hydrocarbyl and each $R^7$ is independently H, alkoxyalkyl, hydroxyalkyl, a hydrocarbyl group, an aminohydrocarbyl group, or an N-alkoxyalkyl or hydroxyalkyl substituted aminohydrocarbyl group and a is as defined hereinabove.

In a particularly preferred embodiment, A is a group of the formula (X)

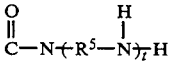

wherein $R^5$ is an ethylene, propylene or butylene group, most preferably ethylene, and t is a number ranging from 1 to about 4.

In still another embodiment at least one A has the formula (IX)

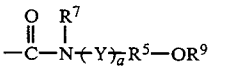

wherein each Y is a group of the formula

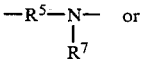

each $R^5$ is independently a divalent hydrocarbyl group, each $R^9$ is independently H or hydrocarbyl and each $R^7$ is H, alkoxyalkyl, hydroxyalkyl, a hydrocarbyl group, an aminohydrocarbyl group, or an N-alkoxyalkyl- or hydroxyalkyl-substituted aminohydrocarbyl group and a is as defined hereinabove.

In one preferred embodiment at least one, and more preferably each, Ar in formula (I) has the formula

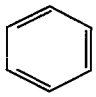 or 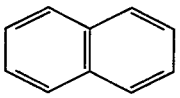

In another preferred embodiment at least one Ar is a linked aromatic group corresponding to the formula

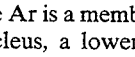

wherein each element of the formula is as described hereinabove. Preferably each ar is independently a benzene nucleus or a naphthalene nucleus, most preferably a benzene nucleus.

In one particularly preferred embodiment, at least one Ar is a member of the group consisting of a benzene nucleus, a lower alkylene bridged, preferably methylene bridged, benzene nucleus or a naphthalene nucleus.

Most preferably each Ar is a benzene nucleus.

In one particularly preferred embodiment at least one Z is —OH or $(OR^5)_bOR^6$, more preferably —OH. Especially preferred is where each Z is —OH.

In another preferred embodiment, each Z is OH, m and c are each one, x=0, Ar has no optional substituents and $R^1$=H.

In an especially preferred embodiment, each Ar is

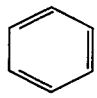

$R^1$ is H or alkyl or alkenyl containing from 1 to about 20 carbon atoms, each R is a hydrocarbyl group containing from 4 to about 300 carbon atoms. Preferably R is alkyl or substantially saturated alkenyl.

Within this especially preferred embodiment the two-stroke cycle lubricants of this invention contain a compound of the formula (X)

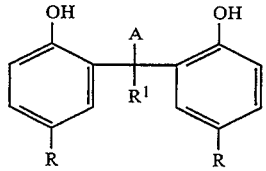

wherein $R^1$ is H or an alkyl or alkenyl group containing from 1 to about 20 carbon atoms and each R is independently a hydrocarbyl group containing from 4 to about 300 carbon atoms and A is an amide or an amide-containing group.

With respect to this especially preferred embodiment at least one A is preferably a group of the formula (X)

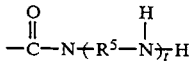

wherein $R^5$ is an ethylene, propylene or butylene group, and t is a number ranging from 1 to about 4.

In another embodiment at least one A is an amide group of the formula

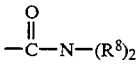

wherein each $R^8$ is independently H or a hydrocarbyl group.

In a particular embodiment, both $R^8$ are H.

In another particular embodiment at least one $R^8$ is hydrocarbyl, preferably alkyl, more, preferably lower alkyl and the other $R^8$ is H. Especially preferred is where one $R^8$ is methyl, ethyl or propyl and the other $R^8$ is H.

Also within the aforementioned especially preferred embodiment, the two-stroke cycle lubricants of this invention contain a compound of the formula

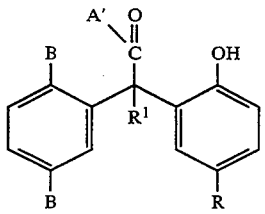

(VII)

wherein $R^1$ is H or an alkyl or alkenyl group containing from 1 to about 20 carbon atoms and each R is independently a hydrocarbyl group containing from 4 to about 300 carbon atoms, and A' is OH or $(OR^5)_bOH$ wherein $R^5$ is a lower alkylene group and b is a number ranging from 0 to about 30, and B is OH or A' and B together are —O— such that the compound comprises a lactone.

The products of employed as additives in the two-stroke cycle lubricant compositions of this invention may be readily prepared by reacting (a) at least one reactant of the formula $$R_m-\underset{\underset{(H)_s}{|}}{Ar}-Z_c \qquad \text{(XI)}$$

wherein R is a hydrocarbyl group as defined hereinabove, m ranges from 0 to about 6, preferably 1 or 2, most preferably 1, Ar is an aromatic group containing from 5 to about 30 carbon atoms having from 0 to 3 optional substituents selected from the group described hereinabove, wherein s is an integer of at least 1 and c ranges from 1 to about 3, wherein the total of s+m+c does not exceed the number of valences of Ar available for substitution and Z is as defined hereinabove, and (b) a carboxylic reactant of the formula $$R^1CO(CR^2R^3)_xCOOR^{10} \qquad \text{(XII)}$$

wherein each of $R^1$, $R^2$ and $R^3$ is independently H or a hydrocarbyl group, $R^{10}$ is H or an alkyl group, and x is a number ranging from 0 to about 8 and, optionally, with (c) ammonia or an amine having at least one N—H group, as described in greater detail hereinbelow, to form an amide.

When $R^1$ is H, the aldehyde moiety of reactant (XII) may be hydrated. For example, glyoxylic acid is readily available commercially as the hydrate having the formula $HCOCO_2H.H_2O$ or

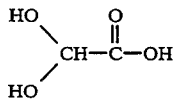

Glyoxylic acid monohydrate is the preferred reactant and is readily available commercially, for example from Hoechst-Celanese, Aldrich Chemical and Chemie-Linz.

Water of hydration as well as any water generated by the condensation reaction is preferably removed during the course of the reaction.

Ranges of values and descriptions of the groups and subscripts appearing in the above formulae (XI) and (XII) are the same as recited hereinabove for formulae (I) and (III). When $R^{10}$ is an alkyl group it is preferably a lower alkyl group, most preferably, ethyl or methyl.

The reaction of (XI) and (XII) is normally conducted in the presence of a strong acid catalyst. Particularly useful catalysts are illustrated by methanesulfonic acid and para-toluenesulfonic acid. The reaction is usually conducted with the removal of water.

Reactants (a) and (b) are preferably present in a molar ratio of about 2:1; however, useful products may be obtained by employing an excess amount of either reactant. Thus, molar ratios of (a):(b) of 1:1, 2:1, 1:2, 3:1, etc. are contemplated and useful products may be obtained thereby. Illustrative examples of reactants (a) of formula (XI) include hydroxy aromatic compounds such as phenols, both substituted and unsubstituted within the constraints imposed on Ar hereinabove, alkoxylated phenols such as those prepared by reacting a phenolic compound with an epoxide, and a variety of aromatic hydroxy compounds. In all the above cases, the aromatic groups bearing the Z groups may be single ring, fused ring or linked aromatic groups as described in greater detail hereinabove.

Specific illustrative examples of compound (XI) employed in the preparation of compounds of formula (I) include phenol, naphthol, 2,2'-dihydroxybiphenyl, 4,4-dihydroxybiphenyl, 3-hydroxyanthracene, 1,2,10-anthracenetriol, resorcinol, 2-t-butyl phenol, 4-t-butyl phenol, 2-t-butyl alkyl phenols, 2,6-di-t-butyl phenol, octyl phenol, cresols, propylene tetramer-substituted phenol, propylene oligomer (MW 300–800)-substituted phenol, polybutene ($M_n$ about 1000)-substituted phenol, substituted naphthols corresponding to the above exemplified phenols, methylene-bis-phenol, bis-(4-hydroxyphenyl)-2,2-propane, and hydrocarbon substituted bisphenols wherein the hydrocarbon substituents are, for example, methyl, butyl, heptyl, oleyl, polybutenyl, etc., sulfide-and polysulfide-linked analogues of any of the above, alkoxylated derivatives of any of the above hydroxy aromatic compounds, etc. Preferred compounds of formula (XI) are those that will lead to preferred compounds of formula (III). Especially preferred are para-alkyl phenols.

The method of preparation of numerous alkyl phenols is well-known, and is generally not a critical feature of this invention. Illustrative examples of alkyl phenols and related aromatic compounds and methods for preparing same are give in U.S. Pat. No. 4,740,321 to Davis et al. This patent is hereby incorporated herein by reference for relevant disclosures contained therein.

Non-limiting examples of the carboxylic reactant (b) of formula (XII) include glyoxylic acid and other omega-oxoalkanoic acids, keto alkanoic acids such as pyruvic acid, levulinic acid, ketovaleric acids, ketobutyric acids and numerous others. The skilled worker will readily recognize the appropriate compound of formula (XII) to employ as a reactant to generate a given intermediate. Preferred compounds of formula (XII) are those that will lead to preferred compounds of formula (III).

U.S. Pat. Nos. 2,933,520 (Bader) and 3,954,808 (Elliott et. al.) describe procedures for preparing the lactone or carboxylic acid via reaction of a phenol and acid. These patents are expressly incorporated herein by reference for relevant disclosures contained therein.

Optionally, the product obtained from the reaction of the foregoing hydroxy aromatic compounds and carboxylic acids may be reacted with ammonia or an amine having at least one N—H group. Suitable amine reactants will be described hereinbelow.

Examples of reactants are intended to be illustrative of suitable reactants and are not intended to be, and should not be viewed as, an exhaustive listing thereof.

The compound arising from the reaction of (a) and Co) may be a carboxylic acid or a lactone, depending upon the nature of (a). In particular, when (a) is a highly hindered hydroxy aromatic compound, the product from (a) and (b) may be predominantly a carboxylic acid. If the 2- and 6- positions are occupied, the carboxylic acid is the sole product. When the hydroxy aromatic reactant (a) is less hindered, a lactone is generated. Para-substituted phenols usually result in lactone formation.

Often, the product arising from the reaction of (a) and (b) is a mixture comprising both lactone and carboxylic acid, although lactone usually predominates.

It will be appreciated that the reaction of reactants (a) and (b) will lead to a compound containing a group Z, as described hereinabove except that when the product is a lactone, Z may be absent.

Amine Reactants

Suitable amines, as defined herein, contain at least one N—H group and include monoamines or polyamines. Polyamines, as defined herein, are amines having at least two nitrogen atoms. The monoamines generally contain from 1 to about 24 carbon atoms, preferably 1 to about 12, and more preferably 1 to about 6 even more preferably, 1 to 3. Examples of monoamines useful in the present invention include primary amines, for example methylamine, ethylamine, propylamine, butylamine, octylamine, and dodecylamine. Examples of secondary amines include dimethylamine, diethylamine, dipropylamine, dibutylamine, methylbutylamine, ethylhexylamine, etc. Tertiary monoamines will not result in formation of an amide.

In another embodiment, the monoamine may be a hydroxyamine. Typically, the hydroxyamines are primary or secondary alkanolamines or mixtures thereof. As stated above, tertiary monoamines will not react to form amides; however tertiary alkanol monoamines sometimes can react to form a tertiary amino group containing ester. They tend to resist reaction with the lactone intermediate. However, when the intermediate contains carboxylic acid groups, reaction with the —OH group of alkanolamines can lead to ester formation. Alkanol amines that can react to form amide can be represented, for example, by the formulae:

$$H_2N—R'—OH, \text{ and}$$

$$\begin{matrix} H \\ \diagdown \\ N—R'—OH, \\ \diagup \\ R_4 \end{matrix}$$

wherein each $R_4$ is independently a hydrocarbyl group of one to about 22 carbon atoms or hydroxyhydrocarbyl group of two to about 22 carbon atoms, preferably one to about four, and R′ is a divalent hydrocarbyl group of about two to about 18 carbon atoms, preferably two to about four. The group —R′—OH in such formulae represents the hydroxyhydrocarbyl group. R′ can be an acyclic, alicyclic or aromatic group. Typically, R′ is an acyclic straight or branched alkylene group such as an ethylene, 1,2-propylene, 1,2-butylene, 1,2-octadecylene, etc. group. When two $R^4$ groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each $R^4$ is independently a methyl, ethyl, propyl, butyl, pentyl or hexyl group.

The hydroxyamines can also be ether N-(hydroxyhydrocarbyl) amines. These are hydroxypoly(hydrocarbyloxy) analogs of the above-described hydroxy amines (these analogs also include hydroxyl-substituted oxyalkylene analogs). Such N-(hydroxyhydrocarbyl) amines can be conveniently prepared, for example, by reaction of epoxides with aforedescribed amines and can be represented by the formulae:

$$H_2N—(R'O)_x—H,$$

$$\begin{matrix} H \\ \diagdown \\ N—(R'O)_x—H, \\ \diagup \\ R_4 \end{matrix}$$

and $$\begin{matrix} R_4 \\ \diagdown \\ N—(R'O)_x—H \\ \diagup \\ R_4 \end{matrix}$$

wherein x is a number from about 2 to about 15 and $R_4$ and R′ are as described above. $R_4$ may also be a hydroxypoly(hydrocarbyloxy) group.

Other useful amines include ether amines of the general formula $$R_6OR^1NHR_7$$

wherein $R_6$ is a hydrocarbyl group, preferably an aliphatic group, more preferably an alkyl group, containing from 1 to about 24 carbon atoms, $R^1$ is a divalent hydrocarbyl group, preferably an alkylene group, containing from two to about 18 carbon atoms, more preferably two to about 4 carbon atoms and $R_7$ is H or hydrocarbyl, preferably H or aliphatic, more preferably H or alkyl, more preferably H. When $R_7$ is not H, then it preferably is alkyl containing from one to about 24 carbon atoms. Especially preferred ether amines are those available under the name SURFAM ® produced and marketed by Sea Land Chemical Co.

The amine may also be a polyamine. The polyamine may be aliphatic, cycloaliphatic, heterocyclic or aromatic. Examples of the polyamines include alkylene polyamines, hydroxy containing polyamines, arylpolyamines, and heterocyclic polyamines.

Alkylene polyamines are represented by the formula

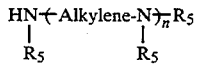

wherein n has an average value between about 1 and about 10, preferably about 2 to about 7, more preferably about 2 to about 5, and the "Alkylene" group has from. 1 to about 10 carbon atoms, preferably about 2 to about 6, more preferably about 2 to about 4. $R_5$ is independently hydrogen or an aliphatic or hydroxy-substituted aliphatic group of up to about 30 carbon atoms. Preferably $R_5$ is H or lower alkyl, most preferably, H.

Alkylene polyamines include methylene polyamines, ethylene polyamines, butylene polyamines, propylene polyamines, pentylene polyamines, etc. Higher homologs and related heterocyclic amines such as piperazines and N-amino alkyl-substituted piperazines are also included. Specific examples of such polyamines are ethylene diamine, triethylene tetramine, tris-(2-aminoethyl)amine, propylene diamine, trimethylene diamine, tripropylene tetramine, dimethylaminopropyl amine, tetraethylene pentamine, hexaethylene heptamine, pentaethylenehexamine, etc.

Particularly preferred polyamines are these wherein one amino group has at least one, preferably two hydrogens and the second amino group and further amino groups are substantially free of H atoms. By substantially free is meant having no more than 2, preferably no more than 1 hydrogen atom per every 10 second or further amino groups. Preferably, such polyamines contain no hydrogen atoms on the second or further amino groups.

Illustrative useful amines of this type include dialkyl aminoalkyl amines, N-hydrocarbyl substituted piperazines, and the like.

Higher homologs obtained by condensing two or more of the above-noted alkylene amines are similarly useful as are mixtures of two or more of the aforedescribed polyamines.

Ethylene polyamines, such as some of those mentioned above, are preferred polyamines. They are described in detail under the heading Ethylene Amines in Kirk Othmer's "Encyclopedia of Chemical Technology", 2d Edition, Vol. 7, pages 22–37, Interscience Publishers, New York (1965). Such polyamines are most conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as the aforedescribed piperazines. Ethylene polyamine mixtures are useful.

Other useful types of polyamine mixtures are those resulting from stripping of the above-described polyamine mixtures to leave as residue what is often termed "polyamine bottoms". In general, alkylene polyamine bottoms can be characterized as having less than two, usually less than 1% (by weight) material boiling below about 200° C. A typical sample of such ethylene polyamine bottoms obtained from the Dow Chemical Company of Freeport, Tex., designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably diethylenetriamine), 0.72% triethylenetetramine, 21.74% tetraethylene pentaamine and 76.61% pentaethylene hexamine and higher (by weight). These alkylene polyamine bottoms include cyclic condensation products such as piperazine and higher analogs of diethylenetriamine, triethylenetetramine and the like.

Another useful polyamine is a condensation product obtained by reaction of at least one hydroxy compound with at least one polyamine reactant containing at least one primary or secondary amino group. The hydroxy compounds are preferably polyhydric alcohols and amines. Preferably the hydroxy compounds are polyhydric amines. Polyhydric amines include any of the above-described monoamines reacted with an alkylene oxide (e.g., ethylene oxide, propylene oxide, butylene oxide, etc.) having two to about 20 carbon atoms, preferably two to about four. Examples of polyhydric amines include tri-(hydroxypropyl)amine, tris-(hydroxymethyl)amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine.

Polyamine reactants, which react with the polyhydric alcohol or amine to form the condensation products or condensed amines, are described above. Preferred polyamine reactants include triethylenetetramine (TETA), tetraethylenepentamine (TEPA), pentaethylenehexamine (PEHA), and mixtures of polyamines such as the above-described "amine bottoms".

The condensation reaction of the polyamine reactant with the hydroxy compound is conducted at an elevated temperature, usually about 60° C. to about 265° C. in the presence of an acid catalyst.

The amine condensates and methods of making the same are described in Steckel (U.S. Pat. No. 5,053,152) which is incorporated herein by reference for its disclosure to the condensates and methods of making.

In another embodiment, the polyamines are hydroxy-containing polyamines. Hydroxy-containing polyamine analogs of hydroxy monoamines, particularly alkoxylated alkylenepolyamines can also be used. Such polyamines can be made by reacting the above-described alkylene amines with one or more of the above-described alkylene oxides. Similar alkylene oxide-alkanolamine reaction products can also be used such as the products made by reacting the aforedescribed primary, secondary or tertiary alkanolamines with ethylene, propylene or higher epoxides in a 1.1 to 1.2 molar ratio. Reactant ratios and temperatures for carrying out such reactions are known to those skilled in the art.

Specific examples of alkoxylated alkylenepolyamines include N-(2-hydroxyethyl) ethylenediamine, N ,N-di-(2-hydroxy ethyl)-ethylenediamine, 1-(2-hydroxyethyl)piperazine, mono-(hydroxy propyl)-substituted tetraethylenepentamine, N-(3-hydroxybutyl)-tetramethylene diamine, etc. Higher homologs obtained by condensation of the above illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the aforesaid polyamines are also useful.

In another embodiment, the polyamine may be a heterocyclic polyamine. The heterocyclic polyamines include aziridines, azetidines, azolidines, tetra- and dihydropyridines, pyrroles, indoles, piperidines, imidazoles, di- and tetrahydroimidazoles, piperazines, isoindoles, purines, N-aminoalkylmorpholines, N-aminoalkylthiomorpholines, N-aminoalkylpiperazines, N,N'-bis-aminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, or nitrogen with oxygen and/or sulfur in the hetero ring, especially the piperidines, piperazines, thiomorpholines, morpholines, pyrrolidines, and the like. Piperidine, aminoalkylsubstituted piperidines, piperazine, aminoalkylsubstituted piperazines, morpholine, aminoalkylsubstituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy alkyl substituted heterocyclic polyamines are also useful. Examples include N-hydroxyethylpiperazine and the like.

In another embodiment, the amine is a polyalkene-substituted amine. These polyalkene-substituted amines are well known to those skilled in the art. They are disclosed in U.S. Pat. Nos. 3,275,554; 3,438,757; 3,454,555; 3,565,804; 3,755,433; and 3,822,289. These patents are hereby incorporated by reference for their disclosure of polyalkene-substituted amines and methods of making the same.

Typically, polyalkene-substituted amines are prepared by reacting halogenated-, preferably chlorinated-, olefins and olefin polymers (polyalkenes) with amines (mono- or polyamines). The amines may be any of the amines described above. Examples of these compounds include poly(propylene)amine; N,N-dimethyl-N-poly(ethylene/propylene)amine, (50:50 mole ratio of monomers); polybutene amine; N,N-di(hydroxyethyl)-N-polybutene amine; N-(2-hydroxypropyl)-N-polybutene amine; N-polybutene-aniline; N-polybutenemorpholine; N-polybutene)ethylenediamine; N-poly(-propylene)trimethylenediamine; N-poly(butene)diethylenetriamine; N',N'-poly(butene)tetraethylenepentamine; N,N-dimethyl-N'-poly(propylene)-1,3-propylenediamine and the like.

The polyalkene substituted amine is characterized as containing from at least about 8 carbon atoms, preferably at least about 30, more preferably at least about 35 up to about 300 carbon atoms, preferably 200, more preferably 100. In one embodiment, the polyalkene substituted amine is characterized by an n (number average molecular weight) value of at least about 500. Generally, the polyalkene substituted amine is characterized by an n value of about 500 to about 5000, preferably about 800 to about 2500. In another embodiment n varies between about 500 to about 1200 or 1300.

The polyalkenes from which the polyalkene substituted amines are derived include homopolymers and interpolymers of polymerizable olefin monomers of 2 to about 16 carbon atoms; usually 2 to about 6, preferably 2 to about 4, more preferably 4. The olefins may be monoolefins such as ethylene, propylene, 1-butene, isobutene, and 1-octene; or a polyolefinic monomer, preferably diolefinic monomer, such 1,3-butadiene and isoprene. Preferably, the polymer is a homopolymer. An example of a preferred homopolymer is a polybutene, preferably a polybutene in which about 50% of the polymer is derived from isobutylene. The polyalkenes are prepared by conventional procedures.

Amide forms by reaction of ammonia or the amine with the lactone, opening the lactone ring, forming an amide, or from direct reaction with a carboxylic acid group. It is generally preferred to utilize sufficient ammonia or amine reactant to convert substantially all of the carboxylic acid or lactone to amide; however, conversion of at least 50%, more preferably 75% of lactone or carboxylic acid to amide is often acceptable. Preferably, at least 90%, more preferably 99–100% conversion of lactone or carboxylic acid to amide is effected.

The reaction of the lactone or carboxylic acid with an amine to prepare the amides of this invention is conducted at temperatures ranging from about 25° C. to about 230° C., preferably 60° C.–150° C., more preferably 100°–110° C. For reaction with ammonia, a maximum of about 70° C. is preferred. Under certain conditions, imidazoline or oxazoline formation may occur. These are frequently obtained by first preparing the amide then continuing the reaction at elevated temperature to generate imidazoline or oxazoline.

Imidazoline formation will not occur with every amine; the amine must have the structural element:

$$H_2NCRCR—NH—R^f.$$

Similarly, oxazoline formation can take place when the amine is a $\beta$-hydroxyethyl amine, e.g., $$HO\ CRCR—NH_2$$

In the above formulae, each $R^f$ is independently H, alkoxyalkyl, hydroxyalkyl, hydrocarbyl, aminohydrocarbyl or N-alkoxyalkyl- or hydroxyalkyl-substituted amino hydrocarbyl.

Thus, if imidazoline or oxazoline formation is not desired, they may be avoided by employing amine reactants that do not provide the opportunity for imidazoline or oxazoline formation, or, if the amine employed can lead to oxazoline or imidazoline, to minimize formation thereof by conducting the reaction at the lowest temperature to prepare amide at an acceptable rate and in acceptable amounts, or to avoid prolonged heating of the amide-containing product, once it has formed. Infrared analysis and water removal monitoring during the reaction are convenient means for determining the nature and extent of the reaction.

When ammonia is employed as reactant (c), it is preferred that it is substantially anhydrous, e.g., containing less that about 5% water, more preferably less than 2% by weight water. It is especially preferred that the ammonia reactant contains less than 0.1% water.

The following specific illustrative examples describe the preparation of the compounds of formula (III) useful in the compositions of this invention. In the following examples, as well as in the claims and in the specification of this application, unless otherwise indicated, parts are parts by weight, the temperature is degrees Celsius and the pressure is atmospheric. Where numerical values of pressure are given they are expressed in millimeters mercury pressure and in kiloPascal (kPa). In several examples, amounts of liquids are given as parts by volume. In those examples, the relationship between parts by weight and parts by volume is as grams and milliliters.

As will be readily apparent to those skilled in the art, variations of each of the illustrated reactants and combination of reactants and conditions may be used.

EXAMPLE 1

Part A:

A mixture is prepared by combining 2300 parts of a polybutene-substituted phenol prepared by boron trifluoride-phenol catalyzed alkylation of phenol with a polybutene having a number average molecular weight of approximately 1000 (vapor phase osmometry-VPO), 151.1 parts 50 percent aqueous glyoxylic acid (Hoechst Celanese) and 1.15 parts 70 percent aqueous methanesulfonic acid in a reactor equipped with a stirrer, thermowell, subsurface gas inlet tube and a Dean-Stark trap with a reflux condenser for water removal. The mixture is heated to 125° C. under a nitrogen sweep, water is collected in the Dean-Stark trap at 125°–135° C. for 1.5 hours, the temperature is increased over 0.5 hours to 158° C. and held there for 2.5 hours, continuing water collection in the Dean-Stark trap. A total of 103 parts by volume water is collected.

To the above mixture is charged 814.3 parts of aromatic hydrocarbon solvent (HI-SOL 10, Ashland Chemical Company), while the reaction mixture cools from 158° C. to 121° C. in 0.25 hours. Cooling is continued over 1.75 hours to 44° C.

Part B:

To the cooled solution is added 105.2 parts diethylenetriamine (Aldrich) which is accompanied by an exothermic reaction from 44° C. to 55° C. over 8 minutes. The reaction mixture is heated over 0.5 hours to 115° C. and is held there for 1 hour. Infrared analysis at this point shows no lactone carbonyl remaining at 1785 $cm^{-1}$, and the appearance of an amide carbonyl at 1643 $cm^{-1}$.

The reaction is vacuum filtered at 110°–115° C., at no less than. 100 millimeters mercury pressure (13.3 kPa), employing a diatomaceous earth filter aid. The filtrate contains, by analysis, 1.31 percent nitrogen, and has a neutralization number (basic) of 32.5. Gel permeation chromatography shows a peak molecular weight (77.5 percent) of 2495.

EXAMPLE 2

Part A:

To a reactor equipped as described in Example 1-A, are charged 5498 parts of a polybutene substituted phenol similar to that described in Example 1 and containing 1.51 percent OH, 361 parts 50 percent aqueous glyoxylic acid (Aldrich) and 3.7 parts paratoluene sulfonic acid monohydrate (Eastman). The materials are heated under nitrogen to 150° C. and held at 150°–160° C. for 7 hours, collecting 245 parts by volume water in the Dean-Stork trap. The reaction product is filtered at 140°–150° C. employing a diatomaceous earth filter aid. Gel permeation chromatography (GPC) shows 100 percent centered at 3022 molecular weight.

Part B:

To another reactor equipped as above are charged 1200 parts of the above reaction product and 54 parts diethylene triamine (Union Carbide). The materials are heated under nitrogen to 110° C. and held at 110°–120° C. for 8 hours, collecting additional distillate in the Dean-Stark trap. The materials are cooled at which time 413 parts toluene are added. The product is vacuum filtered at 120 millimeters mercury pressure (16 kPa) employing a diatomaceous earth filter aid.

EXAMPLE 3

Part A:

A carboxylic compound is prepared by reacting at 145°–150° C. for 10 hours 2215 parts of the polybutene-substituted phenol described in Example 2 and 137 parts 50 percent aqueous glyoxylic acid (Aldrich) in the presence of 1.5 parts paratoluene sulfonic acid for a period of 10 hours, collecting 91 parts water in a Dean-Stark trap. The saponification number (KOH) of this product is 25.3.

Part B:

To a reactor are charged 1145 parts of the foregoing reaction product and 36.5 parts of a mixture of commercial ethylene polyamines having from 3 to about 10 nitrogen atoms per molecule and a nitrogen content of about 35 percent. The materials are heated under nitrogen to 155° C. and held at 155°–160° C. for 8 hours, collecting 3.3 parts water in a Dean-Stark trap. Xylene (495 parts) is added and the solution is vacuum filtered employing a diatomaceous earth filter aid. The filtrate contains, by analysis, 0.77 percent nitrogen and has a neutralization number (basic) of 11.9. GPC analysis of the solution shows 67.6 percent has molecular weight of 3209 and. 32.4 percent is the xylene solvent.

EXAMPLE 4

The process of Example 3-B is repeated employing 1050 parts of the polybutene-substituted phenol-glyoxylic acid reaction product, 20.9 parts of the amine mixture and 356 parts xylene. The xylene solution contains, by analysis, 0.52 percent nitrogen and has a neutralization number (basic) of 6.1. GPC analysis shows 73.3 percent has a molecular weight of 3256 and 26.7 percent is xylene solvent.

EXAMPLE 5

Part A:

To a reactor are charged 2401 parts of polybutene-substituted phenol, 157.8 parts glyoxylic acid, each as described in Example 2, and 1.2 parts 70 percent aqueous methanesulfonic acid. The materials are heated under nitrogen over 3 hours to 155° C. and held at 155°–160° C. for 3 hours, collecting a total of 102 parts water, followed by addition of 857 parts of the aromatic hydrocarbon solvent described in Example 1.

Part B:

At 27° C. added, all at one time, are ethylene polyamine bottoms identified as HPA-X (Union Carbide) having an equivalent weight of 118.8 per primary amine, exotherming over 5 minutes to 39° C. The reaction is heated to 115° C. over 1 hour and held at 115°–120° C. for 4 hours. The materials are filtered employing a diatomaceous earth filter aid at 110°–120° C. at a pressure no less than 100 millimeters mercury (13.3 kPa).

EXAMPLE 6

Part A:

The process of Example 5-A is repeated employing 2222 parts of the polybutene substituted phenol and 146 parts of the 50 percent aqueous glyoxylic acid described in Example 2, 1.5 parts paratoluene sulfonic acid monohydrate and 600 parts by volume xylene. The materials are heated under nitrogen at reflux (170° C. maximum) for 7 hours, collecting 103 parts water in a Dean-Stark trap.

Part B:

At 25° C., added are 208.5 parts of the amine described in Example 5, which has an equivalent weight, per nitrogen, of 40.5. Following refluxing at 170° C. maximum for 6 hours, while collecting 16 parts water, the materials are vacuum stripped to 170° C. over 3 hours, 1666 parts mineral oil diluent are added and the oil solution is filtered employing a diatomaceous earth filter aid at 140°-150° C. The oil solution has a nitrogen content, by analysis, of 1.61% and a neutralization number (basic) of 39.6.

EXAMPLE 7

Part A:

Following the general procedure described in the foregoing examples, 3105 parts of polybutene-substituted phenol and 204 parts 50 percent aqueous glyoxylic acid (Aldrich) are reacted under nitrogen in the presence of 2.1 parts paratoluene sulfonic acid monohydrate (Eastman) at 150°-160° C. for 10 hours, collecting a total of 131 parts water. The materials are filtered employing a diatomaceous earth filter aid.

Part B:

To another reactor are charged 368 parts of the foregoing reaction product and 16.4 parts of N,N-dimethyl-1,3-propanediamine (Eastman) followed by heating at 125°-130° C. for 7 hours. Infrared analysis shows no lactone remaining after the heating period. To the reaction product are added 128 parts toluene, the solution is stirred thoroughly at 95°-100° C. and collected. The solution has, by analysis, 0.87 percent nitrogen.

EXAMPLE 8

To a reactor are charged 308 parts of the polybutene-substituted phenolglyoxylic acid reaction product of Example 7 and 9.82 parts of triethylenetetramine. The materials are heated under nitrogen at 120°-130° C. for 7 hours at which time no lactone carbonyl remains by infrared analysis. Xylene (106 parts) is added and the materials are stirred thoroughly at 90°-100° C. and collected. The xylene solution contains, by analysis, 0.86 percent nitrogen.

EXAMPLE 9

Part A:

To a reactor equipped as described in Example 1 are charged 1350 parts of polybutene-substituted phenol and 89 parts 50 percent aqueous glyoxylic acid as described in Example 2, 0.9 parts paratoluene sulfonic acid monohydrate (Eastman) and 400 parts by volume xylene, followed by heating under nitrogen at reflux (maximum temperature 170° C.) for 5 hours while collecting 63 parts water in a Dean-Stark trap.

Part B:

The reaction mixture is cooled, 125.4 parts tetraethylenepentylamine are added and the materials are again heated at reflux (maximum temperature 170° C.) for 6 hours collecting 12 parts water in the Dean-Stark trap. Solvent is removed by stripping to 150° C. at 30 millimeters mercury (4 kPa) over 4 hours followed by addition of 1002 parts mineral oil diluent, and filtration at 120°-130° C. employing a diatomaceous earth filter aid. The filtrate contains, by analysis, 1.67 percent nitrogen.

EXAMPLE 10

To a reactor are charged 350 parts of the polybutene-substituted phenolglyoxylic acid reaction product described in Example 2, 23 parts trishydroxymethylaminomethane (Kodak) and 200 parts by volume xylene. The materials are heated under nitrogen at 140°-150° C. for 10 hours while collecting 0.5 parts water in a Dean-Stark trap. Xylene is removed by vacuum stripping to 150° C. at 30 millimeters mercury (4 kPa) over 3 hours, mineral oil diluent (158 parts) is added and the oil solution is filtered at 130°-140° C. employing a diatomaceous earth filter aid. The filtrate contains, by analysis, 0.40 percent nitrogen.

EXAMPLE 11

Part A:

Following essentially the procedures of the foregoing examples, 3210 parts polybutene-substituted phenol and 211 parts 50 percent aqueous glyoxylic acid, both as described in Example 2, are reacted at 165°-170° C. in the presence of 2.2 parts paratoluene sulfonic acid monohydrate while removing 148 parts water. The saponification number of this material is 24.4.

Part B:

To another reactor are charged 450 parts of the foregoing reaction product, and 118 parts of a polyalkoxy alkyl primary amine having an equivalent weight of about 600 (Jeffamine M-600, Texaco Chemical Co.). Following heating under nitrogen at 125°-135° C. for 7 hours, infrared analysis shows no lactone remains. The product is diluted with 189.3 parts xylene and filtered at 120° C. and a pressure not less than 100 millimeters mercury (13.3 kPa) employing a diatomaceous earth filter aid. The filtrate solution contains, by analysis, 0.41 percent nitrogen.

EXAMPLE 12

A reactor is charged with 350 parts of the polybutene-substituted phenolglyoxylic acid reaction product described in Example 7, 19.7 parts of N-(2-aminoethyl-piperazine (Union Carbide) and 158.4 parts mineral oil. The materials are reacted under nitrogen at 140°-150° C. for 10 hours at which time the infrared shows no lactone remains. Filtered at 125° C. with a diatomaceous earth filter aid. The product contains, by analysis, 1.36 percent nitrogen.

EXAMPLE 13

Part A:

A reactor equipped as described in Example 1-A is charged with 2070 parts of a $C_{24-28}$ alkyl substituted phenol prepared by the acid catalyzed alkylation of phenol with a $C_{24-28}$ alphaolefin mixture, 316 parts 50 percent aqueous glyoxylic acid (Aldrich), 4 parts paratoluene sulfonic acid (Eastman) and 700 parts by volume of xylene, heated under nitrogen at 160°-170° C. for 7 hours, removing 217 parts water followed by vacuum stripping to 140° C. at 30 millimeters mercury pressure (4 Kpa) over 4 hours. The residue is filtered at 130°-140° C. employing a diatomaceous earth filter aid.

Part B:

Another reactor is charged with 400 parts of the foregoing product and 48.9 parts of aminoethylpiperazine (Union Carbide). The materials are heated under nitrogen at 125°-130° C. for 6 hours at which time the infrared analysis shows no remaining lactone. The product is filtered at 125°-130° C. employing a diatomaceous earth filter aid. The filtrate contains, by analysis, 3.41 percent nitrogen and the infrared shows amide carbonyl absorption.

EXAMPLE 14

Part A:

A reactor is charged with 2849 parts of a polypropylene-substituted phenol prepared by alkylation of phenol with a polypropylene having a molecular weight of about 400 in the presence of a boron trifluorideether catalyst, 415 parts of 50 percent aqueous glyoxylic acid (Aldrich) and 4 parts of paratoluene sulfonic acid monohydrate (Eastman). The reactants are heated to 155° C. over 3 hours and heating is continued at 155°-160° C. for 4 hours during which time 278 parts water is collected. The product obtained has a saponification number of 54.7.

Part B:

Another reactor is charged with 600 parts of the foregoing product and 73.3 parts of N-aminoethylpiperazine (Union Carbide). The materials are heated under nitrogen at 110°-120° C. for 3 hours after which time infrared analysis shows no lactone remains. The materials are diluted with 224.3 parts xylene then vacuum filtered at 110°-120° C. at a pressure not less than 100 millimeters mercury (13.3 kPa) employing a diatomaceous earth filter aid. The filtrate contains, by analysis, 2.67 percent nitrogen.

EXAMPLE 15

Part A:

A reactor is charged with 1976 parts of a propylene tetramer-substituted phenol prepared by alkylation of phenol with a propylene tetramer in the presence of a sulfonated polystyrene catalyst (Amberlyst 15, Rohm & Haas Co.), 558 parts of 50 percent aqueous glyoxylic acid (Aldrich) and 3 parts paratoluene sulfonic acid monohydrate. The materials are heated under nitrogen at 160°-170° C. over 8 hours while collecting 375 parts water. The materials are filtered employing a diatomaceous earth filter aid.

Part B:

To another reactor are charged 300 parts of the foregoing product and 68.9 parts of N-aminoethylpiperazine (Union Carbide). The materials are reacted under nitrogen at 125°-130° C. for 6 hours after which time the infrared shows no lactone carbonyl remains at 1790 $cm^{-1}$. Toluene diluent is added, solution is effected by heating at 100°-110° C. for 2 hours and the materials are collected. The solution contains, by analysis, 4.43 percent nitrogen.

EXAMPLE 16

Part A:

To a reactor equipped as described in Example 1-A are charged 5250 parts of a polypropylene alkylated phenol prepared by alkylating phenol with a polypropylene having an average molecular weight of about 840 (Amoco Chemicals) in the presence of a boron trifluoride catalyst, 377 parts of 50 percent aqueous glyoxylic acid (Aldrich) and 2.9 parts 70 percent aqueous methane sulfonic acid. The materials are reacted under nitrogen by heating to 160° C. over 3 hours and holding at that temperature for 3 additional hours while collecting 240 parts water.

Part B:

To another reactor are charged 2531 parts of the foregoing product, 156 parts N-aminoethylpiperazine (Union Carbide) and 896 parts of the aromatic hydrocarbon solvent described in Example 1. The materials are reacted under nitrogen at 120°-125° C. for 3 hours at which time the infrared analysis shows no lactone carbonyl remains. The materials are filtered employing a diatomaceous earth filter aid at 110°-115° C. and a pressure not less than 100 millimeters mercury (13.3 kPa). The filtrate contains, by analysis, 1.48 percent nitrogen.

EXAMPLE 17

To a reactor as described in Example 1-B are charged 300 parts of the polyisobutene-substituted phenol-glyoxylic acid reaction product described in Example 2, 13.6 parts of aminoethylethanolamine and 70 parts by volume toluene. The materials are heated under nitrogen to 115° C. and held at 115°-125° C. for 4 hours while collecting water in a Dean-Stark trap. The materials are cooled then vacuum stripped to 100° C. at 25 millimeters mercury pressure (3.3 kPa) over 3 hours. Xylene, 103.3 parts is added to the residue, mixed thoroughly and the product is vacuum filtered warm at 120 millimeters mercury pressure (16 kPa) employing a diatomaceous earth filter aid.

EXAMPLE 18

A reactor is charged with 350 parts of the polypropylene-substituted phenol-glyoxylic acid reaction product of Example 1.5 and 75.3 parts of trishydroxymethylaminomethane, the materials are heated to 135° C. and held at 5°-140° C. for 10 hours. Xylene is added and the materials are stirred at 100°- 110° C. for 2 hours followed by filtration at about 100° C. employing a diatomaceous earth filter aid. The filtrate contains, by analysis, 1.27 percent nitrogen.

EXAMPLE 19

Part A:

To a reactor as described in Example 1-A are charged 3371 parts of a polybutene-substituted phenol having an equivalent weight based on percent OH of 1126, 221.3 parts 50% aqueous glyoxylic acid and 1.7 parts 70 percent aqueous methane sulfonic acid. The materials are heated to 115°-120° C. at which point water evolution begins. The materials are heated to 160° C. and held at that temperature for 2.5 hours while collecting a total of 148 parts water. The materials are filtered employing a diatomaceous earth filter aid and collected.

Part B:

Another reactor is charged with 425 parts of the foregoing reaction product, 26.7 parts N-aminopropylmorpholine and 150.6 parts of aromatic hydrocarbon solvent. The materials are heated under nitrogen at 115°-120° C. for 3 hours after which time the infrared analysis shows no lactone carbonyl remains. The product is filtered employing a diatomaceous earth filter aid at 115°-120° C. The filtrate contains, by analysis, 0.83 percent nitrogen and the infrared spectrum shows amide carbonyl.

EXAMPLE 20

A reactor is charged with 350 parts of the alkylated phenol-glyoxylic acid reaction product described in Example 13 and 33.8 parts of N,N-dimethyl-1,3-propanediamine (Eastman) followed by heating under nitrogen to 125° C. The materials are heated at 125°-135° C. for 7 hours; infrared analysis at this point shows no lactone remains unreacted. The materials are filtered employing diatomaceous earth filter aid at 125°-135° C. The filtrate contains, by analysis, 2.08 percent nitrogen.

EXAMPLE 21

Part A:

A reactor is charged with 1552 parts of a polybutene-substituted phenol as described in Example 1, 1338 parts of the $C_{24-28}$ phenol described in Example 13, 306 parts 50 percent aqueous glyoxylic acid (Aldrich), 3 parts paratoluene sulfonic acid monohydrate (Eastman) and 600 parts by volume xylene solvent. The materials are heated under nitrogen to reflux and held at reflux (maximum temperature 180° C.) for 12 hours while collecting 213 parts water in a Dean-Stark trap. The materials are vacuum stripped to 150° C. and 30 millimeters mercury pressure over 3 hours and filtered at 140°–150° C. employing a diatomaceous earth filter aid.

Part B:

Another reactor is charged with 400 parts of the foregoing reaction product and 31 parts of N,N-dimethyl-1,3-propanediamine (Eastman) followed by heating under nitrogen at 125°–130° C. for 7 hours. The product is filtered employing diatomaceous earth filter aid at about 125° C. The residue contains, by analysis, 1.62 percent nitrogen and the infrared shows amide carbonyl is present and lactone carbonyl is absent.

EXAMPLE 22

A reactor is charged with 750 parts of the alkylated phenol-glyoxylic reaction product described in Example 21 and 41.6 parts of triethylene tetramine followed by heating under nitrogen at 130°–135° C. for 8 hours. At this point the infrared spectrum shows no lactone remains. The materials are filtered employing a diatomaceous earth filter aid at 135°–140° C. The filtrate contains, by analysis, 1.83 percent nitrogen.

EXAMPLE 23

Part A:

A reactor is charged with 3000 parts of the $C_{24-28}$ alkylated phenol described in Example 13, 457 parts of 50 percent aqueous glyoxylic acid (Hoechst Celanese) and 4.2 parts 70 percent aqueous methane sulfonic acid followed by heating under nitrogen to 125° C. over 0.5 hours. The materials are held at 125°–130° C. for 2 hours, collecting water in a Dean-Stark trap. The temperature is increased over 0.3 hours to 150° C. and is held at that temperature for 3 hours; a total of 302 parts water is collected. The reaction is cooled to 120°–125° C. and filtered employing a diatomaceous earth filter aid.

Part B:

Another reactor is charged with 406 parts of the foregoing reaction product. At 60° C. under nitrogen, 229.3 parts of polyoxyethylene-oxypropylene-diamine (Jeffamine ED600, Texaco Chemicals) are added over 0.2 hours while the temperature rises exothermically to 65° C. The reaction temperature is increased to 150° C. over 0.5 hours and is held there for 3 hours. The materials are filtered employing a diatomaceous earth filter aid. The infrared analysis shows the presence of amide and the absence of lactone. The product contains, by analysis, 1.52 percent nitrogen.

EXAMPLE 24

Part A:

To a reactor are charged 1942.8 parts of the $C_{24-28}$ alkylated phenol described in Example 13, 1048 parts of the tetrapropylene-substituted phenol described in Example 18, 592 parts of the 50 percent aqueous glyoxylic acid as described in Example 23 and 5.5 parts of 70 percent aqueous methane sulfonic acid. The materials are heated under nitrogen to 125° C. over 0.5 hours and are held at that temperature for 2 hours. Water is collected employing a Dean-Stark trap. The temperature is increased to 151 ° C. over 0.5 hours and held at that temperature for 3 hours while collecting additional water in the Dean-Stark trap. The materials are cooled to 125° C. and filtered employing a diatomaceous earth filter aid. The saponification number of the residue is 74.9. The residue contains, by analysis, 2.17 percent OH.

Part B:

To another reactor is charged 393 parts of the foregoing reaction product which is then heated to 60° C. under a nitrogen blanket. Over 0.2 hours 285 parts of the amine described in Example 23 are added while the temperature rises exothermically to 71° C. The temperature is increased to 150° C. over 0.5 hours and held at that temperature for 3 hours. The product contains, by analysis, 1.86 percent nitrogen. Infrared analysis shows the presence of amide carbonyl.

EXAMPLE 25

Part A:

A reactor is charged with 1360 parts nonylphenol, 457 parts 50 percent aqueous glyoxylic acid (Aldrich) and 1.8 parts 70 percent aqueous methane sulfonic acid. The materials are heated under nitrogen to reflux (120° C.) and then to a maximum temperature of 155° C. for 7 hours while collecting water in a Dean-Stark trap.

Part B:

To another reactor are charged 220 parts of the foregoing reaction product, 46.9 parts of N,N-dimethyl-1,3-propanediamine (Eastman) and 114.4 parts of aromatic hydrocarbon solvent. The materials are heated under nitrogen at 110°–120° C. for 4 hours after which time the infrared spectrum shows no lactone remains. The materials are filtered employing a diatomaceous earth filter aid at 100°–110° C. at a pressure no lower than 100 millimeters mercury (13.3 kPa). The filtrate contains, by analysis, 3.33 percent nitrogen.

EXAMPLE 26

A reactor is charged with 220 parts of the nonylphenol-glyoxylic reaction product described in Example 25, 59.4 parts of N-aminoethylpiperazine (Union Carbide) and 93.1 parts aromatic hydrocarbon solvent. The materials are heated under nitrogen at 1. 00°–110° C. for 4 hours after which time the infrared analysis shows no lactone remains. The materials are filtered employing a diatomaceous earth filter aid at 100° C. at a pressure not lower than 100 millimeters mercury (13.3 kPa). The filtrate contains, by analysis, 5.18 percent nitrogen.

EXAMPLE 22

Part A:

A reactor is charged with 3005 parts of the polypropylene-substituted phenol described in Example 14, 439 parts 50 percent aqueous glyoxylic acid (Aldrich) and 4.2 parts paratoluene sulfonic acid monohydrate (Eastman). The materials are heated with stirring and below surface nitrogen blowing to 170° C. over 4 hours while holding the temperature at 170° C. for 3 hours, removing a total of 298 parts water. The materials are filtered hot employing a diatomaceous earth filter aid.

Part B:

Another reactor is charged with 450 parts of the foregoing reaction product and 66.6 parts of aminoguanidine bicarbonate (Aldrich) followed by heating under nitrogen to 150° C. The materials are held at 150°- 160° C. for 10 hours while collecting 10 parts water in a Dean-Stark trap. Xylene (162 parts) is added, the materials are stirred for 0.5 hours and vacuum filtered employing a diatomaceous earth filter aid at a temperature of 110°-120° C. at a pressure not less than 100 millimeters mercury (13.3 kPa). The filtrate contains, by analysis, 3.89 percent nitrogen.

EXAMPLES 28-34

Parts A and B:

Reaction products are prepared substantially according to the procedure of Example 1, replacing the polybutene substituted phenol with an equivalent amount, based on the molecular weight, of the alkylated hydroxy aromatic compounds listed in the following Table I

TABLE I

| Example | Name | Mol. Wt.[1] |
|---|---|---|
| 28 | 2,2'-dipoly(isobutene)yl-4,4'-dihydroxybiphenyl | 2500 |
| 29 | 8-hydroxy-poly(propene)yl-1-azanaphthalene | 900 |
| 30 | 4-poly(isobutene)yl-1-naphthol | 1700 |
| 31 | 2-poly(propene/butene-1)yl-4,4'-isopropylidene-bisphenol[2] | 3200 |
| 32 | 4-tetra(propene)yl-2-hydroxy-anthracene | — |
| 33 | 4-octadecyl-1,3-dihydroxybenzene | — |
| 34 | 4-poly(isobutene)-3-hydroxy-pyridine | 1300 |

[1]Number average molecular weight by vapor phase osmometry
[2]The molar ratio of propene to butene-1 in the substituent is 2:3.

EXAMPLE 35

Parts A and B:

The procedure of Example 3 is repeated except the polybutene has an average molecular weight of about 1400.

EXAMPLE 36

Parts A and B:

The procedure of Example 9 is repeated employing a substituted phenol (having an —OH content of 1.88%, prepared by reacting polyisobutenyl chloride having a viscosity at 99° C. of 1306 SUS (Sayboldt Universal Seconds) and containing 4.7% chlorine with 1700 parts phenol).

EXAMPLE 37

Parts A and B:

The procedure of Example 15 is repeated replacing the propylene tetramer substituted phenol with an equivalent number of moles of a sulfurized alkylated phenol prepared by reacting 1000 pans of a propylene tetramer substituted phenol as described in Example 15 with 175 parts of sulfur dichloride and diluted with 400 parts mineral oil.

EXAMPLE 38

Parts A and B:

The procedure of Example 37 is repeated replacing the sulfurized phenol with a similar sulfurized phenol prepared by reacting 1000 parts of propylene tetramer substituted phenol with 319 parts of sulfur dichloride.

EXAMPLE 39

Parts A and B:

The procedure of Example 1 is repeated replacing glyoxylic acid with an equivalent amount, based on —COOH, of pyruvic acid.

EXAMPLE 40

Parts A and B:

The procedure of Example 6 is repeated replacing glyoxylic acid with an equivalent amount, based on —COOH, of levulinic acid.

EXAMPLES 41-43

Parts A and B:

The procedure of Example 3 is repeated employing the keto alkanoic acids given in Table II.

TABLE II

| Example | Acid |
|---|---|
| 41 | Pyruvic |
| 42 | 3-Ketobutyric |
| 43 | Keto valeric |

EXAMPLE 44

Parts A and B:

The procedure of Example 4 is repeated replacing glyoxylic acid with an equivalent amount, based on —COOH, of omega-oxo-valeric acid.

EXAMPLES 45-48

Parts A and B:

The procedures of each of Examples 1-4 is repeated replacing the alkylated phenol with a propylene tetramer-substituted catechol.

EXAMPLE 49

To a reactor is charged 1650 parts of the reaction product of Example 16. The materials are heated under nitrogen to 130°-135° C. at which time 34.8 parts propylene oxide are added over 3 hours. The materials are heated at 135° C. for 2 hours and at 140° C. for 1 hour followed by vacuum filtration at 100°-110° C. at a pressure not lower than 100 millimeters mercury (13.3 kPa) employing a diatomaceous earth filter aid. The filtrate contains, by analysis, 1.41 percent nitrogen.

EXAMPLE 50

A reactor is charged with 220 parts of the nonylphenol-glyoxylic acid reaction product of Example 25, 59.4 parts of N-aminoethylpiperazine (Union Carbide) and 131.3 parts of aromatic hydrocarbon solvent. The materials are heated under nitrogen at 110°-120° C. for 1 hour, the temperature is raised to 125° C. and 28 parts propylene oxide are added at 125°-130° C. over 3 hours. The materials are heated at 135°-140° C. for 2 hours, cooled to 110° C. and vacuum filtered at 100°-110° C. at a pressure not lower than 100 millimeters mercury (13.3 kPa) employing a diatomaceous earth filter aid.

EXAMPLE 51

A reactor is charged with 600 parts of the reaction product of Example 2 and the materials are heated to 120° C. under nitrogen. Propylene oxide (24 parts) is added at 120°-130° C. over 4 hours, followed by heating at 120°-130° C. for 3 additional hours.

EXAMPLE 52

A reactor is charged with 800 parts of the reaction product from Example 9. The materials are heated under nitrogen to 125° C. followed by the addition of 23.7 parts propylene oxide over a 6 hour period at 125°-130° C. A dry-ice condenser is employed. The reaction mixture is heated to 130° C. and held at 130°-135° C. for 6 additional hours. The materials are filtered employing diatomaceous earth at 1.30°-135° C. The materials contain, by analysis, 1.60 percent nitrogen.

EXAMPLE 53

Following substantially the same procedure as described in Example 51,600 parts of the reaction product from Example 2 are reacted with 12 parts of propylene oxide.

EXAMPLE 54

Part A:

A reactor is charged with 7000 parts of polybutene-substituted phenol described in Example 1, 460 parts of 50 percent aqueous glyoxylic acid (Aldrich) and 4.8 parts paratoluene sulfonic acid monohydrate (Eastman). The materials are heated under nitrogen at 155°-160° C. for 6 hours collecting 315 parts water in a Dean-Stark trap. The material has a saponification number of 29.6 and shows a molecular weight by gel permeation chromatography of 3019.

Part B:

Another reactor is charged with 778 parts of the foregoing reaction product and 43.9 parts of aminoethylpiperazine (Union Carbide). The materials are heated under nitrogen at 110°-115° C. for 3 hours. Xylene, 280.5 parts, is added and the materials are heated to 130° C. followed by the addition of 21.7 parts propylene oxide at 130°-135° C. over 3 hours. The reaction heating is continued at 135°-140° C. for 4 hours followed by vacuum filtration employing a diatomaceous earth filter aid at 110°-120° C. and a pressure not less than 100 millimeters mercury (13.3 kPa). The infrared analysis shows no lactone carbonyl is present. The filtrate contains, by analysis, 1.29 percent nitrogen.

EXAMPLE 55

Part A:

A reactor is charged with 5640 parts of polybutene-substituted phenol as described in Example 1, 371 parts of 50 percent aqueous glyoxylic acid (Hoechst Celanese) and 2.83 parts 70 percent aqueous methane sulfonic acid. The materials are heated over 2.5 hours to 155° C. and are held at 155°-160° C. for 3 hours collecting 250 parts water in a Dean-Stark trap.

Part B:

Xylene, 2068 parts, is added to the product and the reaction is cooled to 85° C. followed by addition of 323 parts N-aminoethylpiperazine (Union Carbide) which is accompanied by a slight exothermic reaction. The materials are heated over 1.5 hours to 150° C. and held at 150°-155° C. for 1 additional hour collecting 7 additional grams aqueous distillate. The materials are cooled to 130° C. and 158 parts propylene oxide is added over a 3 hour period, the materials are heated followed by vacuum filtration. The filtrate contains, by analysis, 1.30 percent nitrogen.

EXAMPLE 56

A reactor is charged with 400 parts of the alkylated phenol-glyoxylic acid reaction product of Example 13 and 39.1 parts of diethylene triamine. The materials are heated under nitrogen at 120°-125° C. for 7 hours while collecting aqueous distillate in a Dean-Stark trap. Propylene oxide is added under nitrogen at 120°-130° C. over 4 hours. Heating is continued at 120°-1.30° C. for 3 additional hours. The materials are filtered employing a diatomaceous earth filter aid at 120°-130° C.

EXAMPLE 57

A reactor is charged with 1309 parts of a phenol-glyoxylic acid reaction product as described in Example 14, 170 parts N-aminoethylpiperazine (Union Carbide) and 520 parts xylene. The materials are heated under nitrogen to 150° C. over 2 hours and held at that temperature for 1 hour obtaining 1 part water in a trap. To this product are added 85.7 parts propylene oxide over 3.5 hours at 120°-130° C. followed by heating at 125°-130° C. for 3 hours. The materials are vacuum filtered employing a diatomaceous earth filter aid at 110°-115° C. at a pressure not less than 100 millimeters mercury (13.3 kPa).

EXAMPLE 58

The procedure of Example 1 is repeated except that the aromatic hydrocarbon solvent solution of the polybutene-substituted phenol-glyoxylic acid reaction product is added to the diethylenetriamine.

EXAMPLE 59

A reactor is charged with 269 parts of the phenol-glyoxylic acid reaction product of Example 11, Part A, 16.9 parts of aminopropylmorpholine and 95.5 parts of xylene. Heated under $N_2$ to 145° C. over 4 hours. The hot solution is vacuum filtered at 130° C. employing a diatomaceous earth filter aid. The filtrate contains, by analysis, 0.79% N.

EXAMPLE 60

Part A

A reactor is charged with 1481 parts of the propylene tetramer substituted phenol of Example 15,418 parts of 50% aqueous glyoxylic acid and 2.2 parts of 70% methane sulfuric acid. Heated 6 hours under $N_2$ while removing 293 parts aqueous distillate. Filtered hot at 140°-150° C. employing a diatomaceous earth filter aid.

Part B

Another reactor is charged with 225 parts of the product of Part A and 158 parts mineral oil. Heated under $N_2$ to 60° C. added 31 parts methylamine (40% aqueous) over 0.5 hours, held 1 hour at 60° C., heated to reflux (~100° C.), held at ~100° C. for 4 hours. Stripped to 120° C. at 30 mm Hg. Filtered through diatomaceous earth filter aid yielding filtrate containing, by analysis, 1.1% N.

EXAMPLE 61

A reactor is charged with 3005 parts of a propylene tetramer substituted phenol prepared by reacting polypropylene with phenol in the presence of 4% by weight $BF_3$ at 80° C., 439 parts 50% aqueous glyoxylic acid (Aldrich) and 4.2 parts paratoluene sulfonic acid monohydrate (Eastman). The materials are heated under nitrogen to 170° C. over 7 hours removing 298 parts aqueous distillate. The materials are filtered using a diatomaceous earth filter acid. The filtrate has a saponification number=46.3.

EXAMPLE 62

A reactor is charged with 6000 parts of a propylene tetramer substituted phenol as described in Example 15 Part A, 2 liters toluene, 1695 parts of 50% aqueous glyoxylic acid (Aldrich) and 9.44 parts paratoluene sulfonic acid monohydrate. The materials are heated at reflux (maximum 137° C.) under $N_2$ for 6.5 hours while removing 1170 parts aqueous distillate. The reaction product is stripped to 160° C./30 mm Hg over 5 hours. Mineral oil, 5482 parts is stirred into the residue and the oil solution is filtered using a diatomaceous earth filter aid. The filtrate has a saponification number of 56.9.

EXAMPLE 63

Part A

A reactor is charged with 1002 parts 2,4,-di-t-butylphenol, 360 parts glyoxylic acid, 400 milliliters toluene and 2 parts paratoluene sulfonic acid monohydrate. Heated at reflux under $N_2$ for 12 hours while collecting 250 parts aqueous distillate. Stripped to 140° C. and 5 mm Hg over 4 hours followed by filtration at 130°-140° C. employing a diatomaceous earth filter aid. Saponification number=121.

Part B

To 150 parts of the filtrate of Part A is added 93.3 parts N-tallow propane diamine (Duomeen T - Akzo) and 101 parts xylene. Heated to reflux, removing a total of 3.4 parts aqueous distillate over 12 hours. Filtered xylene solution employing diatomaceous earth filter aid at about 120 mm Hg, yielding 25% xylene solution containing, by analysis 2.44% N.

EXAMPLE 64

Part A

A reactor is charged with 3537 parts of a propylene tetramer substituted phenol as described in Example 15, Part A, 999 parts 50% aqueous glyoxylic acid, and 3.8 parts 70% methane sulfonic acid. Under $N_2$, the materials are heated to 160° C. over 2 hours then held at 160° C. for 3.4 hours while collecting 697 milliliters aqueous distillate. The materials are diluted with 2710 parts mineral oil, cooled to 80° C. then filtered using a Whatman GF/D microfibrous glass filter.

Part B

To another reactor is charged 538.2 parts of the filtrate of Part A, then heated to 45° C. A mixture of $N_2$ (30 cc/hour) and $NH_3$ (6 g/hour) is added until 48 g $NH_3$ is added. Temperature increases to 68° C. over 0.5 hours after $NH_3$addition begins. After 5 hours infrared spectrum shows loss of peak at 1786 $cm^{-1}$ and appearance of peak at 1655 $cm^{-1}$, most of reaction at 45° C. Increased to 60° C., after 0.5 hours peak at 1786 $cm^{-1}$ begins to develop. Discontinue heating and filter. Filtrate contains, by analysis, 1.96%N.

EXAMPLE 65

Part A

A reactor is charged with 2210 parts of the polybutene-substituted phenol of Example 1,135 parts 50% aqueous glyoxylic acid and 1.4 parts of paratoluene sulfonic acid. Heated under $N_2$ at 140°-150° C. for 12 hours removing 91 parts aqueous distillate. Added 1000 parts mineral oil then filtered at 130°-140° C. using a diatomaceous earth filter aid. Saponfication no=18.6.

Part B-1

A reactor is charged with 1250 parts of the oil solution of Part A and 22.7 parts tetraethylene pentamine. Heated, under $N_2$ at 155°-160° C. for 16 hours yielding 1.7 milliliters of aqueous distillate. Filtered at 145°-150° C. employing a diatomaceous earth filter aid. Filtrate contains, by analysis, 0.63% N.

Part B-2

The procedure of Part B-1 is repeated employing 34 parts tetraethylene pentamine and removing 3.0 milliliters aqueous distillate. The filtrate contains by analysis, 0.89%N.

EXAMPLE 66

A reactor is charged with 700 parts of a polybutene substituted phenolglyoxylic acid reaction product prepared essentially according to the process of Example 2-A, 473 parts of mineral oil, and 23.7 parts of methylamine (40% aqueous) at 42° C. The materials are heated at 80° C. for 3 hours, stripped to 95° C. at 20 mm Hg for 3 hours and filtered employing a diatomaceous earth filter aid. The filtrate contains, by analysis, 0.41% N.

EXAMPLE 67

Part A

Following substantially the procedure of Example 15-A o-t-butyl phenol is reacted with glyoxylic acid.

Part B

The product of Part A is dried by xylene azeotrope under $N_2$ followed by stripping to 160° C./18 mm Hg.

Another reactor is charged with 236 parts Jeffamine M-600 and 110 parts hydrocarbon solvent and dried under $N_2$ at 120° C. for 1 hour. The dried Jeffamine solution is added to the dried product of Part A at 100° C., the temperature drops to 90° C. and the mixture is stirred 1.5 hours at 90°-70° C.

EXAMPLE 68

The procedure of Example 64B is followed employing 488 parts of an 80% in oil solution of a nonylphenolglyoxylic acid reaction product similar to that of Example 25, and 75 parts $NH_3$. Product contains, by analysis, 1.78%N.

EXAMPLES 69

Following essentially the procedure of Example 68, the dinonylphenol derivative is obtained (35% oil, %N, by analysis=0.39)

EXAMPLE 70

The process of example 60-A is repeated except the product contains 40% mineral oil diluent.

In addition to the carboxylic compositions of Formula III use of other additives in the 2-stroke cycle lubricating compositions of this invention is contemplated.

It is sometimes useful to incorporate, on an optional, as-needed basis, other known additives which include, but are not limited to, dispersants and detergents of the ash-producing or ashless type, antioxidants, anti-wear agents, extreme pressure agents, emulsifiers, demulsifiers, metal passivators, foam inhibitors, friction modifiers, anti-rust agents, corrosion inhibitors, viscosity improvers, pour point depressants, dyes, lubricity agents, and solvents to improve handleability which may include alkyl and/or aryl hydrocarbons. These optional additives may be present in various amounts depending on the intended application for the final product or may be excluded therefrom.

The ash-containing detergents are the well-known neutral or basic Newtonian or non-Newtonian, basic salts of alkali, alkaline earth and transition metals with one or more hydrocarbyl sulfonic acid, carboxylic acid, phosphoric acid, mono- and/or dithio phosphoric acid, phenol or sulfur coupled phenol, and phosphinic and thiophosphinic acid. Commonly used metals are sodium, potassium, calcium, magnesium, lithium, copper and the like. Sodium and calcium are most commonly used.

Neutral salts contain substantially equivalent amounts of metal and acid. As used herein., the expression basic salts refers to those compositions containing an excess amount of metal over that normally required to neutralize the acid substrate. Such basic compounds are frequently referred to as overbased, superbased, etc.

Metal salts, particularly alkali metal salts, more particularly sodium salts, of the carboxylic composition obtained by reacting a phenolic compound with carboxylic reactant of formula $R^1$ CO $(CR^2R^3)_xCOOR^{10}$ as described in U.S. Pat. No. 5,281,346 (Adams et al), alkyl phenols described in U.S. Pat. Nos. 4,708,809 and 4,740,321 and fatty imidazolines are known additives used for 2-stroke cycle applications which may optionally be used in the compositions of this invention.

Dispersants include, but are not limited to, acylated nitrogen-containing dispersants, including hydrocarbon substituted succinimides and succinamides; carboxylic esters, including polyolefin substituted succinic polyesters, Mannich dispersants, including these derived from monoamines, polyamines and alkanolamines aminophenol dispersants, aminocarbamate dispersants, imidazolines and alkyl phenols having at least 10 carbon atoms in the alkyl group and mixtures thereof as well as materials functioning both as dispersants and viscosity improvers. Nitrogen-containing carboxylic dispersants are prepared by reacting a hydrocarbyl carboxylic acylating agent (usually a hydrocarbyl substituted succinic anhydride) with an amine (usually a polyamine). Ester dispersants are prepared by reacting a polyhydroxy compound with a hydrocarbyl carboxylic acylating agent. The ester dispersant may be further treated with an amine. Mannich dispersants are prepared by reacting a hydroxy aromatic compound with an amine and aldehyde. The dispersants listed above may be post-treated with reagents such as urea, thiourea, carbon disulfide, aldehydes, ketones, carboxylic acids, hydrocarbon substituted succinic anhydride, nitriles, epoxides, boron compounds, phosphorus compounds and the like. These dispersants are generally referred to as ashless dispersants even though they may contain elements such as boron or phosphorus which, on decomposition, will leave a non-metallic residue.

Extreme pressure agents and corrosion- and oxidation-inhibiting agents include chlorinated compounds, sulfurized compounds, phosphorus containing compounds including, but not limited to, phosphosulfurized hydrocarbons and phosphorus esters, metal containing compounds and boron containing compounds.

Chlorinated compounds are exemplified by chlorinated aliphatic hydrocarbons such as chlorinated wax.

Examples of sulfurized compounds are organic sulfides and polysulfides such as benzyl disulfide, bis(-chlorobenzyl)disulfide, dibutyl tetrasulfide, sulfurized methyl ester of oleic acid, sulfurized alkylphenol, sulfurized dipentene, and sulfurized terpene.

Phosphosulfurized hydrocarbons include the reaction product of a phosphorus sulfide with turpentine or methyl oleate.

Phosphorus esters include dihydrocarbon and trihydrocarbon phosphites, phosphates and metal and amine salts thereof.

Phosphites may be represented by the following formulae:

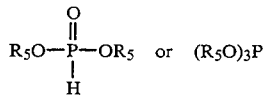

wherein each $R_5$ is independently hydrogen or a hydrocarbon based group, provided at least one $R_5$ is a hydrocarbon based group.

Phosphate esters include mono-, di- and trihydrocarbon-based phosphates of the general formula $$(R^5O)_3P$$

Examples include mono-, di- and trialkyl; mono-, di and triaryl and mixed alkyl and aryl phosphates.

Metal containing compounds include metal thiocarbamates, such as zinc dioctyldithiocarbamate, and barium heptylphenyl dithiocarbamate and molybdenum compounds.

Boron containing compounds include borate esters and boron-nitrogen containing compounds prepared, for example, by the reaction of boric acid with a primary or secondary alkyl amine.

Metal passivators include aromatic amines, triazoles, thiadiazoles, etc.

Viscosity improvers include, but are not limited to, polyisobutenes, polymethacrylate acid esters, polyacrylate acid esters, diene polymers, polyalkyl styrenes, alkenyl aryl conjugated diene copolymers, polyolefins and multifunctional viscosity improvers.

Pour point depressants are a particularly useful type of additive often included in the lubricating oils described herein. See for example, page 8 of "Lubricant Additives" by C. V. Smalheer and R. Kennedy Smith (Lesius-Hiles Company Publishers, Cleveland, Ohio, 1967).

Lubricity agents include synthetic polymers (e.g., polyisobutene having a number average molecular weight in the range of about 750 to about 15,000, as measured by vapor phase osmometry or gel permeation chromatography), polyolether (e.g., poly (oxyethylene-oxypropylene ethers) and ester oils. Natural oil fractions such as bright stocks (the relatively viscous products formed during conventional lubricating oil manufacture from petroleum) can also be used for this purpose. They are usually present, when used in two-cycle oils in amounts of about 3% to about 20% by weight of the total composition.

Diluents include such materials as petroleum hydrocarbons (e.g., Stoddard Solvent, kerosene, etc.). When used, they are typically present in amounts ranging from about 5% to about 25% by weight but amounts greater than this are sometimes used.

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125–162.

These and other additives are described in greater detail in U.S. Pat. No. 4,582,618 (column 14, line 52 through column 17, line 16, inclusive), herein incorporated by reference for its disclosure of other additives that may be used in the compositions of the present invention.

The components may be blended together in any suitable manner and then admixed, for example with a diluent to form a concentrate as discussed below, or with a lubricating oil, as discussed below. Alternatively, components can be admixed separately with such diluent or lubricating oil. The blending technique for mixing the components is not critical and can be effected using any standard technique, depending upon the specific nature of the materials employed. In general, blending can be accomplished at room temperature; however, blending can be facilitated by heating the components.

As previously indicated, the compositions of the present invention are useful as additives for lubricants for 2-stroke cycle engines. They can be employed in a variety of lubricant basestocks comprising diverse oils of lubricating viscosity, including natural and synthetic lubricating oils and mixtures thereof.

Natural oils include animal oils, vegetable oils, mineral lubricating oils, solvent or acid treated mineral oils, and oils derived from coal or shale. Synthetic lubricating oils include hydrocarbon oils, halo-substituted hydrocarbon oils, alkylene oxide polymers, esters of carboxylic acids and polyols, esters of polycarboxylic acids and alcohols, esters of phosphorus-containing acids, polymeric tetrahydrofurans, silicon-based oils and mixtures thereof.

Specific examples of oils of lubricating viscosity are described in U.S. Pat. No. 4,326,972 and European Patent Publication 107,282, both herein incorporated by reference for their disclosures relating to lubricating oils. A basic, brief description of lubricant base oils appears in an article by D. V. Brock, "Lubricant Base Oils", *Lubrication Engineering,* volume 43, pages 184–185, March, 1987. This article is herein incorporated by reference for its disclosures relating to lubricating oils. A description of oils of lubricating viscosity occurs in U.S. Pat. No. 4,582,618 (column 2, line 37 through column 3, line 63, inclusive), herein incorporated by reference for its disclosure to oils of lubricating viscosity.

The additives and components of this invention can be added directly to the lubricant. Preferably, however, they are diluted with a substantially inert, normally liquid organic diluent such as mineral oil, naphtha, toluene or xylene, to form an additive concentrate. These concentrates usually contain from about 10% to about 90% by weight of the components used in the composition of this invention and may contain, in addition, one or more other additives known in the art as described hereinabove. The remainder of the concentrate is the substantially inert normally liquid diluent.

As is well known to those skilled in the art, two-cycle engine lubricating oils are often added directly to the fuel to form a mixture of a lubricant and fuel which is then introduced into the engine cylinder. Such lubricant-fuel mixtures are within the scope of this invention. Such lubricant-fuel mixtures generally contain a major amount of fuel and a minor amount of lubricant, more often at least about 10, preferably about 15, more preferably about 20 up to about 100, more preferably up to about 50 parts of fuel per 1 part of lubricant.

Fuels used in two-stroke cycle engines are well known to those skilled in the art and usually contain a major portion of a normally liquid fuel such as hydrocarbonaceous petroleum distillate fuel (e.g., motor gasoline as defined by ASTM Specification D-439-89 and D-4814-91). Fuels containing non-hydrocarbonaceous materials such as alcohols, ether, organo-nitro compounds and the like (e.g., methanol, ethanol, diethyl ether, methyl ethyl ether, nitromethane) are also within the scope of this invention as are liquid fuels derived from vegetable or mineral sources such as corn., alfalfa, shale and coal. Mixtures of fuels, such as mixtures of gasoline and alcohol, for example, methanol or ethanol are among the useful fuels.

Examples of fuel mixtures are combinations of gasoline and ethanol, diesel fuel and ether, gasoline and nitromethane, etc. Particularly preferred is gasoline, that is, a mixture of hydrocarbons having an ASTM boiling point of 60° C. at the 10% distillation point to about 205° C. at the 90% distillation point.

Natural gas and propane are also useful as a fuel for two-stroke cycle engines.

Two-stroke cycle fuel compositions may contain other additives which are well known to those of skill in the art. These may include ethers, such as ethyl-t-butyl ether, methyl-t-butyl ether and the like, alcohols such as ethanol and methanol, lead scavengers such as haloalkanes (e.g., ethylene dichloride and ethylene dibromide), dyes, cetane improvers, antioxidants such as 2,6 ditertiary-butyl-4-methylphenol, rest inhibitors, such as alkylated succinic acids and anhydrides, bacteriostatic agents, gum inhibitors, metal deactivators, demulsifiers, upper cylinder lubricants, anti-icing agents and the like. The invention is useful with lead-free as well as lead-containing fuels.

Two-stroke cycle engine lubricating oils of this invention are illustrated in the following examples. All parts and percentages are by weight and unless indicated otherwise, amounts of components are given on a diluent-free basis. Amounts of components from the preceding Examples are given as prepared and are not adjusted for oil content.

TABLE A

Each of the lubricating oil composition listed in this Table contains 3% of polyisobutene (Mn = 1000), 0.15% of a methylene coupled alkylated naphthalene as described in U.S. Pat. No. 4,753,745, 15% of a hydrocarbon solvent (Stoddard Solvent - defined in ASTM D-484-52) an amount of a component as given in the Table and mineral oil basestock sufficient to total 100% by weight.

| | EXAMPLE | | | | |
|---|---|---|---|---|---|
| Product of Example | A | B | C | D | E |
| 62 | 4 | | | | |
| 61 | | 2 | | | |
| 66 | | | 8 | | 4 |
| 1-A | | | | 4 | |

TABLE B

Each of the lubricating oil compositions listed in this Table contains 0.04% of poly (propoxy-ethoxy) alcohol, 0.15% of a methylene-coupled alkylated naphthalene as described in U.S. Pat. No. 4,753,745, 0.25% of a basic calcium sulfonate, 0.035% of an overbased, carbonated calcium sulfonate, 15% of a hydrocarbon solvent (Stoddard Solvent - defined in ASTM-D-484-52), an amount of a component as given in the Table and mineral oil basestock sufficient to total 100% by weight.

| | EXAMPLE | | | | | |
|---|---|---|---|---|---|---|
| Product of Example | F | G | H | I | J | K |
| 10 | | 6 | | | | |

TABLE B-continued

Each of the lubricating oil compositions listed in this Table contains 0.04% of poly (propoxy-ethoxy) alcohol, 0.15% of a methylene-coupled alkylated naphthalene as described in U.S. Pat. No. 4,753,745, 0.25% of a basic calcium sulfonate, 0.035% of an overbased, carbonated calcium sulfonate, 15% of a hydrocarbon solvent (Stoddard Solvent - defined in ASTM-D-484-52), an amount of a component as given in the Table and mineral oil basestock sufficient to total 100% by weight.

| | EXAMPLE | | | | | |
|---|---|---|---|---|---|---|
| Product of Example | F | G | H | I | J | K |
| 12 | | | 6 | | | |
| 65-B2 | | | | 6 | | |
| 1-A | | | | | 3.6 | |
| 62 | | | | | | 6 |
| 65-B1 | 6 | | | | | |

TABLE C

Each of the lubricating oil compositions listed in this Table contains 0.04% of poly (propoxy-ethoxy) alcohol, 0.15% of a methylene-coupled alkylated naphthalene as described in U.S. Pat. No. 4,753,745, the indicated amount of the product of Example 62 and, where indicated, additional components, 15% Stoddard Solvent and mineral oil basestock sufficient to total 100% by weight.

| | EXAMPLE | | | |
|---|---|---|---|---|
| | L | M | N | O |
| Product of Example 62 | 7 | 3 | 10 | 8 |
| Reaction Product of polybutene (Mn = 1000) substituted succinic anhydride with ethylene polyamines | 2 | | | |
| Polybutene (Mn = 1000) substituted amino phenol | | 7 | | |
| Imidazoline from isostearic acid and polyamine | 1 | | | 2 |

TABLE D

Each of the lubricating oil compositions listed in this Table of contains 3% of polyisobutene (Mn = 1000), 0.15% of methylene-coupled alkylnaphthalene as described in U.S. Pat. No. 4,753,745, 15% Stoddard Solvent, 0.66% of substantially neutral sodium alkyl salicylate, one or more components as shown therein and mineral oil basestock sufficient to total 100% by weight.

| | EXAMPLE | | | | | |
|---|---|---|---|---|---|---|
| Component | P | Q | R | S | T | U |
| Prod. of Ex 66 | 2 | 2 | 4 | | | 2 |
| Prod of Ex 1-A | | | | 4 | | |
| Prod of Ex 62 | | | | | 4 | |
| Sulfurized $C_{12}$-Substituted Phenol | 1.2 | | | | | 1.2 |
| Calcium methylene coupled phenol | 0.16 | | | | | |
| Basic calcium sulfonate | | 0.25 | | | | |
| Polybutene ($M_n$ = 1000) substituted succinic anhydride-ethylene polyamine reaction product | | 1.14 | | | | |

TABLE E

Each of the lubricating oil compositions listed in this Table contents 3% of polybutene (Mn = 1000), 0.15% of methylene-coupled alkyl naphthalene as described in U.S. Pat. No. 4,753,745, 15% Stoddard Solvent, one or more additional components as shown therein and mineral oil basestock sufficient to total 100% by weight.

| | EXAMPLE | | | |
|---|---|---|---|---|
| Component | V | W | X | Y |
| Product of Example 66 | 4 | 4 | 4 | 4 |
| Polybutene-substituted succinic anhydride-ethylene polyamine reaction product | | | | |
| Sodium salt of polybutene ($M_n$ ~ 1000) phenol-glyoxylic acid reaction product | | | 0.9 | 1.5 |
| Sodium alkyl salicylate | | | 0.44 | 0.44 |
| Sodium salt of tetrapropenyl phenol-glyoxylic acid reaction product | | | 0.6 | |

TABLE E-continued

Each of the lubricating oil compositions listed in this Table contents 3% of polybutene (Mn = 1000), 0.15% of methylene-coupled alkyl naphthalene as described in U.S. Pat. No. 4,753,745, 15% Stoddard Solvent, one or more additional components as shown therein and mineral oil basestock sufficient to total 100% by weight.

| | EXAMPLE | | | |
|---|---|---|---|---|
| Component | V | W | X | Y |
| glyoxylic acid reaction product | | | | |

TABLE F

| | Mineral oil basestock + | | | | | | |
|---|---|---|---|---|---|---|---|
| | EXAMPLE | | | | | | |
| Component | Z | AA | AB | AC | AD | AE | AF |
| Polybutene ($M_n$ ~1000) | 3 | 3 | 23 | 23 | 3 | 3 | 3 |
| Methylene-coupled alkylated naphthalene | 0.15 | 0.15 | 0.2 | 0.2 | 0.15 | 0.15 | 0.15 |
| Product of Ex 62 | | | 3 | | | 5.7 | 5.7 |
| Product of Ex 64 | 6 | | | 3 | | | |
| Product of Ex 60 | | | | | 6 | | |
| Product of Ex 70 | | 6 | | | | | |
| Polybutene ($M_n$ ~ 1000) -substituted phenol | | | 4 | 4 | | | |
| Sodium salt of tetrapropylene phenol-glyoxylic acid reaction prod. | | | 0.84 | 0.84 | | | |
| Hydrocarbon solvent | | | 22 | 22 | | 22 | 22 |
| Alkylated diphenyl amine | 0.25 | 0.25 | | | 0.25 | 0.4 | |
| Polybutene (Mn ~ 1000) substituted succinic anhydridepolyamine reaction. product | 3.6 | 3.6 | | | 3.6 | 3 | 6 |
| Kerosene | 20 | 20 | | | 20 | | |
| Fatty imidazoline | 2 | 2 | | | 2 | 3 | 3 |

EXAMPLE AG

The lubricant of Example U also containing 0.25% of basic calcium sulfonate.

EXAMPLE AH

The lubricant of Example Q also containing 2% of the product of Example 62.

EXAMPLE AI

The lubricant of Example A also containing 0.44% neutral sodium salicylate and 0.9% of the sodium salt of reaction product of polybutene ($M_n$~1000) phenol with glyoxylic acid.

EXAMPLE AJ

The lubricant of Example A also containing 1.5% of the sodium salt of the reaction product of polybutene ($M_n$~1000)phenol with glyoxylic acid

EXAMPLE AK

The lubricant of Example D also containing 1.5% of the sodium salt of the reaction product of polybutene ($M_n$~1000) phenol with glyoxylic acid.

As mentioned hereinabove, this invention also relates to methods for lubricating two-stroke cycle engines. In one embodiment, a lubricant for two-stroke cycle engines of this invention is added to a fuel and the engine is operated employing this lubricant-fuel mixture as the operating fuel.

With many engines, particularly larger engines, the fuel and lubricant are supplied separately to the engine. The lubricant may be supplied to the fuel intake system either before or after the carburetor and before the fuel is drawn into the combustion chamber. At least some mixing of the lubricant and fuel takes place under these conditions.

In another embodiment, a lubricant of this invention is supplied to the operating engine separately from the fuel. This may be accomplished by injecting lubricant into the crankcase, then some of the lubricant is drawn into the combustion chamber. Fuel is generally injected directly into the combustion chamber.

In both cases, the lubricant is consumed during combustion and a fresh lubricant is supplied with each fuel charge.

One test employed to evaluate piston skirt varnish and ring sticking performance of two-cycle engine lubricants is the West Bend 10 Hour Deposit Test. The test engine is a gasoline fueled, single cylinder, 134 $cm^3$air-cooled utility two-cycle engine. The engine is operated employing the test lubricant at 50:1 fuel:oil ratio for 10 hours at 5000 rpm, 4.7 horsepower. Numerical ratings are assigned for piston skirt varnish, ring sticking and piston undercrown deposits.

The West-Bend test is used to demonstrate performance of several of the foregoing 2-stroke cycle lubricants. A rating of "10" indicates completely clean.

TABLE G

| Lubricant | Piston Varnish | Undercrown | Ring Sticking |
|---|---|---|---|
| Z | 9.05 | 9.1 | 9.5 |
| AD | 8.7 | 9.3 | 9 |
| AA | 8.2 | 9.3 | 8.8 |

Lubricating oil compositions of this invention when evaluated on the above tests generally provide performance comparable to commercially available two-cycle lubricants and often exceed the performance of these commercial oils.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A 2-stroke cycle engine lubricant composition comprising a major amount of an oil of lubricating viscosity and a minor amount of at least one carboxylic composition prepared by reacting (a) at least one reactant of the formula $$R_m-\underset{\underset{(H)_s}{|}}{Ar}-Z_c \qquad (I)$$

wherein R is a hydrocarbyl group, m ranges from 0 to about 6, Ar is an aromatic group containing from 5 to about 30 carbon atoms and having from 0 to 3 optional substituents selected from the group consisting of polyalkoxyalkyl, lower alkoxy, nitro or combinations of two or more of said optional substituents, wherein s is a number of at least 1, each Z is independently OH or $(OR^5)_bOH$, wherein $R^5$ is independently a divalent hydrocarbyl group and b is a number ranging from 1 to about 30 and c is a number ranging from 1 to about 3, wherein the sum s+m+c does not exceed the number of valences of Ar available for substitution, and (b) a carboxylic reactant of the formula $$R^1CO(CR^2R^3)_xCOOR^{10}$$

wherein each of $R^1$, $R^2$ and $R^3$ is independently H or a hydrocarbyl group, $R^{10}$is H or an alkyl group and x is a number ranging from 0 to about 8; and optionally, (c) ammonia or an amine having at least one N—H group.

2. A lubricant according to claim 1 having at least one R containing from 4 to about 750 carbon atoms.

3. A lubricant according to claim 1 wherein each m is 1 or 2 and each R is an alkyl or alkenyl group.

4. A lubricant according to claim 3 wherein R contains from 30 to about 100 carbon atoms and is derived from homopolymerized and interpolymerized $C_{2-10}$ olefins.

5. A lubricant according to claim 4 wherein the olefins are 1-olefins.

6. A lubricant according to claim 3 wherein R contains from 7 to about 28 carbon atoms.

7. A lubricant according to claim 3 wherein R contains from 12 to about 50 carbon atoms.

8. A lubricant according to claim 1 wherein at least one Ar is a linked aromatic group corresponding to the formula $$ar\langle L-ar\rangle_w$$

wherein each ar is a single ring or a fused ring aromatic nucleus of 5 to about 12 carbons, w is an integer ranging from 1 to about 6 and each L is independently selected from the group consisting of carbon to carbon single bonds between ar nuclei, ether linkages, sulfide linkages, polysulfide linkages, sulfinyl linkages, sulfonyl linkages, lower alkylene linkages, lower alkylene ether linkages, lower alkylene sulfide and/or polysulfide linkages, amino linkages and linkages having the formula

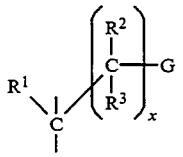

(II)

wherein each of $R^1$, $R^2$ and $R^3$ is independently H, alkyl or alkenyl, each G is independently an amide or an amide-containing group, a carboxyl group, an ester group, an oxazoline-containing group, or an imidazoline containing group, and x is an integer ranging from 0 to about 8, and mixtures of such linkages.

9. A lubricant according to claim 1 wherein at least one Ar is a member of the group consisting of a benzene nucleus, a lower alkylene bridged benzene nucleus or a naphthalene nucleus.

10. A lubricant according to claim 1 wherein each of $R^1$, $R^2$ and $R^3$ is independently hydrogen or a lower alkyl or alkenyl group, and $R^{10}$ is H.

11. A lubricant according to claim 1 wherein at least one Z is —OH.

12. A lubricant according to claim 9 wherein each Z is OH, m and c are each one, x is 0, and Ar has no optional substituents, and $R^1$=H.

13. A lubricant according to claim 3 wherein m is 2, and each Ar contains one tertiary-butyl substituent and one alkyl or alkenyl substituent containing from about 4 to about 100 carbon atoms.

14. The lubricant of claim 1 wherein (c) is ammonia.

15. The lubricant of claim 1 wherein (c) is an amine.

16. The lubricant of claim 15 wherein the amine is a monoamine.

17. The lubricant of claim 15 wherein the amine is an alkylene polyamine.

18. The lubricant of claim 16 wherein the polyamine is an ethylene polyamine or a propylene polyamine.

19. The lubricant of claim 15 wherein the amine in an alkylene polyamine selected from the group consisting of diethylene triamine, ethylene polyamine bottoms, N-aminopropyl morpholine and dimethylaminopropyl amine, or a monoamine selected from the group consisting of methylamine, ethyl amine and propylamine.

20. A 2-stroke cycle engine lubricant composition comprising a major amount of an oil of lubricating viscosity and a minor amount of at least one carboxylic composition of the general formula (III)

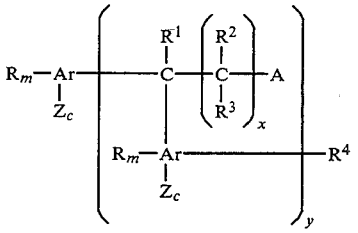

wherein each Ar is independently an aromatic group having from 5 to about 30 carbon atoms and from about 0 to 3 optional substituents selected from the group consisting of amino, hydroxy- or alkylpolyoxyalkyl, nitro, aminoalkyl, carboxy, or combinations of two or more of said optional substituents, each R is independently a hydrocarbyl group, $R^1$ is H or a hydrocarbyl group, $R^4$ is selected from the group consisting of H, a hydrocarbyl group, a member of the group of optional substituents on Ar, or lower alkoxy, each m is independently 0 or an integer ranging from 1 to about 6, x ranges from 0 to about 8, and each Z is independently OH, lower alkoxy or $(OR^5)_bOR^6$, wherein each $R^5$ is independently a divalent hydrocarbyl group, $R^6$ is H or hydrocarbyl and b is a number ranging from 1 to about 30, and c ranges from 1 to about 3, y is a number ranging from 1 to about 10 and wherein the sum m+c does not exceed the number of valences of the corresponding Ar available for substitution, and each A is independently a carboxylic group selected from the group consisting of an amide or amide-containing group, a carboxyl group, a group of the formula

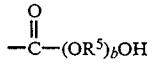

wherein each $R^5$ is independently a divalent hydrocarbyl group and b is a number ranging from 1 to about 30, an imidazoline-containing group, an oxazoline group, an ester group, an acylamino group or one Z and one A are taken together, make up a group of the formula

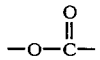

to form a lactone group of the formula (IV)

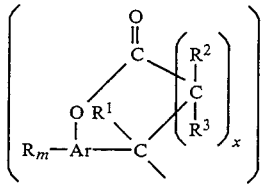

mixtures thereof.

21. A lubricant according to claim 20 wherein at least one A and one Z together are a group of the formula

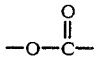

to form a lactone group of the formula (IV)

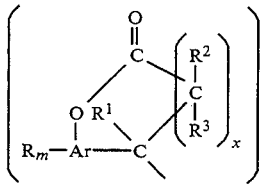

22. A lubricant according to claim 20 wherein at least one A is an amide or an amide-containing group.

23. A lubricant according to claim 20 having at least one R containing from 4 to about 750 carbon atoms.

24. A lubricant according to claim 20 wherein each m is 1 or 2 and each R is an alkyl or alkenyl group.

25. A lubricant according to claim 24 wherein R contains from 30 to about 100 carbon atoms and is derived from homopolymerized and interpolymerized $C_{2-10}$ olefins.

26. A lubricant according to claim 25 wherein the 1-olefins are ethylene, propylene, butenes and mixtures thereof.

27. A lubricant according to claim 24 wherein R contains from 7 to about 28 carbon atoms.

28. A lubricant according to claim 24 wherein R contains from 12 to about 50 carbon atoms.

29. A lubricant according to claim 20 wherein at least one Ar is a linked aromatic group corresponding to the formula

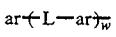

wherein each ar is a single ring or a fused ring aromatic nucleus of 5 to about 12 carbons, w is an integer ranging from 1 to about 6 and each L is independently selected from the group consisting of carbon to carbon single bonds between ar nuclei, ether linkages, sulfide linkages, polysulfide linkages, sulfinyl linkages, sulfonyl linkages, lower alkylene linkages, lower alkylene ether linkages, lower alkylene sulfide and/or polysulfide linkages, amino linkages and linkages having the formula

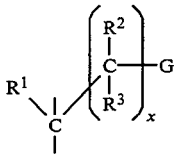

(II)

wherein each of $R^1$, $R^2$ and $R^3$ is independently H, alkyl or alkenyl, each G is independently an amide or an amide-containing group, a carboxyl group, an ester group, an oxazoline-containing group, or an imidazoline containing group, and x is an integer ranging from 0 to about 8, and mixtures of such linkages.

30. A lubricant according to claim 20 wherein at least one Ar is a member of the group consisting of a benzene nucleus, a lower alkylene bridged benzene nucleus or a naphthalene nucleus.

31. A lubricant according to claim 20 wherein each of $R^1$, $R^2$ and $R^3$is independently hydrogen or a lower alkyl or alkenyl group.

32. A lubricant according to claim. 20 wherein at least one Z is —OH.

33. A lubricant according to claim 20 wherein each Z is $(OR^5)_bOR^6$.

34. A lubricant according to claim 33 wherein $R^5$ is a lower alkylene group and $R^6$ is a lower alkyl group.

35. A lubricant according to claim 30 wherein each Z is OH, m and c are each one, x is 0, and Ar has no optional substituents, and $R^1$=H.

36. A lubricant according to claim 34 wherein m is 2, and each Ar contains one tertiary-butyl substituent and one alkyl or alkenyl substituent containing from about 4 to about 100 carbon atoms.

37. A lubricant according to claim 20 wherein at least one A has the general formula

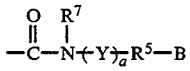

(V)

wherein each Y is a group of the formula

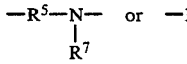

each $R^5$ is a divalent hydrocarbyl group and each $R^7$ is H, alkoxyalkyl, hydroxyalkyl, a hydrocarbyl group, an aminohydrocarbyl group or an N-alkoxyalkyl- or hydroxyalkyl-substituted amino hydrocarbyl group, and B is an amide group, an imide-containing group, an acylamino group or an amide-containing group and a is 0 or a number ranging from 1 to about 100.

38. A lubricant according to claim 37 wherein the group B is selected from acylamino groups of the formula

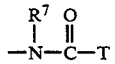

(VI)

wherein each $R^7$ is independently H, alkoxyalkyl, hydroxyalkyl, hydrocarbyl, aminohydrocarbyl or an N-alkoxyalkyl- or N-hydroxyalkyl-substituted amino hydrocarbyl group and T is hydrocarbyl, groups of the formula

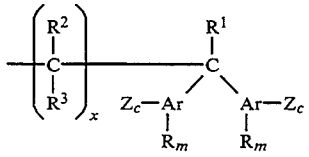

(VII)

wherein each element of formula (VII) is defined in claim 19, or an imide-containing group.

39. A lubricant according to claim 20 wherein at least one A has the formula wherein each Y is a group of the formula

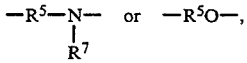

each $R^5$ is independently a divalent hydrocarbyl group, each $R^{11}$ is independently H, alkoxyalkyl, hydroxyalkyl or hydrocarbyl and each $R^7$ is H, alkoxyalkyl, hydroxyalkyl, a hydrocarbyl group, an aminohydrocarbyl group, or an N-alkoxyalkyl or hydroxyalkyl substituted aminohydrocarbyl group and a is 0 or a number ranging from 1 to about 100.

40. A lubricant according to claim 22 wherein each A is a group of the formula

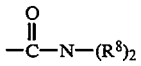

wherein each $R^8$ is independently H, alkoxyalkyl, hydroxyalkyl or hydrocarbyl.

41. A lubricant according to claim 40 wherein each $R^8$ is independently H or lower alkyl.

42. A lubricant according to claim 41 wherein one $R^8$ is H and the other $R^8$ is methyl, ethyl or propyl.

43. A lubricant according to claim 20 wherein at least one A has the formula

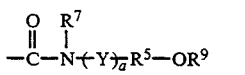

(IX)

wherein each Y is a group of the formula

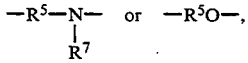

each $R^5$ is independently a divalent hydrocarbyl group, each $R^9$ is independently H or hydrocarbyl and each $R^7$ is H, alkoxyalkyl, hydroxyalkyl, a hydrocarbyl group, an aminohydrocarbyl group, or an N-alkoxyalkyl or hydroxyalkyl substituted aminohydrocarbyl group and a is a number ranging from 0 to about 6.

44. A lubricant according to claim 20 which further comprises an auxiliary dispersant selected from the group consisting of Mannich dispersants, acylated nitrogen dispersants, aminophenol dispersants, ester dispersants, aminocarbamate dispersants, amine dispersants, alkyl phenols having at least 10 carbon atoms in the alkyl group, and imidazolines.

45. A lubricant according to claim 20 which further comprises an auxiliary detergent selected from the group consisting of alkali and alkaline earth overbased sulfonic acids, carboxylic acids and phenols.

46. A 2-stroke cycle engine lubricant composition comprising a major amount of an oil of lubricating viscosity and a minor amount of at least one compound of the general formula (III)

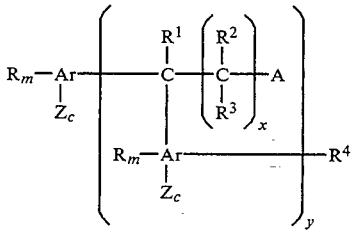

wherein each Ar is independently an aromatic group, at least one Ar has the formula

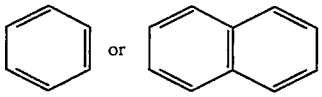

having from 0 to 3 optional substituents selected from the group consisting of amino, hydroxy- or alkylpolyoxyalkyl, nitro, carboxy or combinations of two or more of said optional substituents, or an analog of such an aromatic group, each R is independently a hydrocarbyl group, $R^1$ is H or an alkyl group, $R^2$ and $R^3$ are each, independently, H or an alkyl group, $R^4$ is H or an alkyl group, each m is independently 0 or an integer ranging from 1 to about 10, x ranges from 0 to about 8, and each Z is independently OH, lower alkoxy, $(OR^5)_bOR^6$ or $O^-$ wherein each $R^5$ is independently a divalent hydrocarbyl group, $R^6$ is H or hydrocarbyl and b is a number ranging from 1 to about 30 and c ranges from 1 to about 3, y is a number ranging from 1 to about 10 and wherein the sum m+c does not exceed the number of valences of the corresponding Ar available for substitution and each A is independently an amide group or an amide-containing group.

47. A lubricant according to claim 46 wherein at least one R contains from 7 to about 100 carbon atoms and m is 1 or 2.

48. A lubricant according to claim 46 wherein each R is a substantially saturated aliphatic group.

49. A lubricant according to claim 46 wherein $R^1$ is H or a lower alkyl group, $R^2$ and $R^3$ are independently H or a lower alkyl group, $R^4$ is H or a lower alkyl or alkenyl group and x is 0, 1 or 2.

50. A lubricant according to claim 47 wherein each R contains from about 7 to about 28 carbon atoms and each m is 1.

51. A lubricant according to claim 47 wherein each R contains at least about 30 carbon atoms and m is 1.

52. A lubricant according to claim 47 wherein each R contains from 12 to about 50 carbon atoms and m is 1.

53. A lubricant according to claim 46 wherein each Ar is

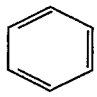

each Z is OH, and c is 1.

54. A lubricant according to claim 42 wherein m is 2, and each Ar contains one tertiary-butyl substituent and one alkyl or alkenyl substituent containing from about 12 to about 100 carbon atoms.

55. A lubricant according to claim 46 wherein each A is a group of the formula

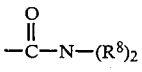

wherein each $R^8$ independently H, alkoxyalkyl, hydroxyalkyl or hydrocarbyl.

56. A lubricant according to claim 55 wherein each $R^8$ is independently H or lower alkyl.

57. A lubricant according to claim 56 wherein one $R^8$ is H and the other $R^8$ is methyl, ethyl or propyl.

58. A lubricant according to claim 46 wherein at least one A has the general formula (V)

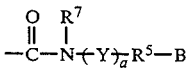

wherein each Y is a group of the formula

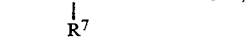

each $R^5$ is independently a divalent hydrocarbyl group and each $R^7$ is independently H, alkoxyalkyl, hydroxyalkyl, a hydrocarbyl group, an aminohydrocarbyl group, or an N-alkoxyalkyl or hydroxyalkyl substituted aminohydrocarbyl group, and B is an amide group, an amide-containing group or an acylamino group, and a is a number ranging from 0 to about 6.

59. A lubricant according to claim 58 wherein the group B is selected from acylamino groups of the formula:

(VI)

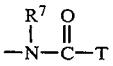

wherein each $R^7$ is independently H, alkoxyalkyl, hydroxyalkyl, hydrocarbyl, aminohydrocarbyl or an N-alkoxyalkyl- or N-hydroxyalkyl-substituted amino hydrocarbyl group and T is hydrocarbyl, groups of the formula (VII)

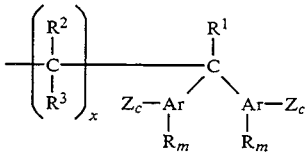

wherein each element of formula (VII) is defined above.

60. A lubricant according to claim 46 wherein at least one A has the formula $$-\overset{O}{\overset{\|}{C}}-\overset{R^7}{\overset{|}{N}}-(Y)_a-R^5-N(R^{11})_2 \quad \text{(VIII)}$$

wherein each Y is a group of the formula $$-R^5-\underset{\underset{R^7}{|}}{N}- \quad \text{or} \quad -R^5O-,$$

each $R^5$ is independently a divalent hydrocarbyl group, each $R^{11}$ is independently H, alkoxyalkyl, hydroxyalkyl, or hydrocarbyl and each $R^7$ is H, alkoxyalkyl, hydroxyalkyl, a hydrocarbyl group, an aminohydrocarbyl group, or an N-alkoxyalkyl or hydroxyalkyl substituted amino hydrocarbyl group, and a is 0 or a number ranging from 1 to about 100.

61. A lubricant according to claim 46 wherein at least one A has the formula $$-\overset{O}{\overset{\|}{C}}-\overset{R^7}{\overset{|}{N}}-(Y)_a-R^5-OR^9 \quad \text{(IX)}$$

wherein each Y is a group of the formula $$-R^5-\underset{\underset{R^7}{|}}{N}- \quad \text{or} \quad -R^5O-,$$

each $R^5$ is independently a divalent hydrocarbyl group, each $R^9$ is independently H or hydrocarbyl and each $R^7$ is independently H, alkoxyalkyl, hydroxyalkyl, a hydrocarbyl group, an aminohydrocarbyl group, or an N-alkoxyalkyl or hydroxyalkyl substituted aminohydrocarbyl group and a is 0 or a number ranging from 1 to about 100.

62. A lubricant according to claim 46 which further comprises an auxiliary dispersant selected from the group consisting of Mannich dispersants, acylated nitrogen containing dispersants, aminophenol dispersants, ester dispersants, aminocarbamate dispersants, amine dispersants, alkyl phenols having at least 10 carbon atoms in the alkyl group and imidazolines.

63. A lubricant according to claim 46 which further comprises an auxiliary detergent selected from the group consisting of alkali and alkaline earth overbased sulfonic acids, carboxylic acids and phenols.

64. A 2-stroke cycle engine lubricant composition comprising a major amount of an oil of lubricating viscosity and a minor amount of at least one compound of the general formula (XI)

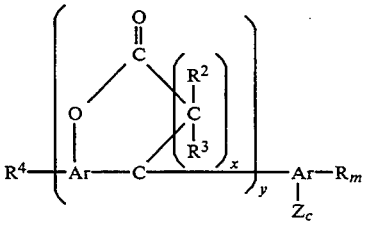

wherein each Ar is independently an aromatic group, at least one Ar has the formula

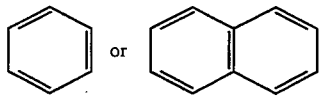

and having from 0 to 3 optional substituents selected from the group consisting of amino, hydroxy- or alkylpolyoxyalkyl, nitro, carboxy or combinations of two or more of said optional substituents, or an analog of such an aromatic group, each R is independently a hydrocarbyl group, $R^1$ is H or an alkyl group, $R^2$ and $R^3$ are each, independently, H or an alkyl group, $R^4$ is H or an alkyl group, each m is independently 0 or an integer ranging from 1 to about 10, x ranges from 0 to about 8, and each Z is independently OH, lower alkoxy, $(OR^5)_bOR^6$ or $O^-$ wherein each $R^5$ is independently a divalent hydrocarbyl group, $R^6$ is H or hydrocarbyl and b is a number ranging from 1 to about 30 and c ranges from 1 to about 3, y is a number ranging from 1 to about 10 and wherein the sum m+c does not exceed the number of valences of the corresponding Ar available for substitution.

65. A lubricant according to claim 64 wherein at least one R contains from 7 to about 100 carbon atoms and m is 1 or 2.

66. A lubricant according to claim 64 wherein each R is a substantially saturated aliphatic group.

67. A lubricant according to claim 64 wherein $R^1$ is H or a lower alkyl group, $R^2$ and $R^3$ are independently H or a lower alkyl group, $R^4$ is H or a lower alkyl or alkenyl group and x is 0, 1 or 2.

68. A lubricant according to claim 64 wherein each R contains from about 7 to about 28 carbon atoms and each m is 1.

69. A lubricant according to claim 64 wherein each R contains at least about 30 carbon atoms and m is 1.

70. A lubricant according to claim 64 wherein each R contains from 12 to about 50 carbon atoms and m is 1.

71. A lubricant according to claim 64 wherein each Ar is

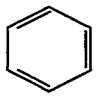

each Z is OH, and c is 1.

72. A lubricant according to claim 64 wherein m is 2, and each Ar contains one tertiary-butyl substituent and one alkyl or alkenyl substituent containing from about 12 to about 100 carbon atoms.

73. A 2-stroke cycle engine lubricant composition comprising a major amount of at least one oil of lubricating viscosity and at least one compound of the formula (X)

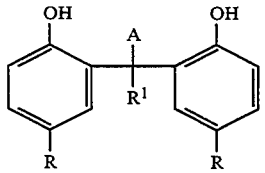

wherein $R^1$ is H or an alkyl or alkenyl group containing from 1 to about 20 carbon atoms and each R is independently a hydrocarbyl group containing from 4 to about 300 carbon atoms and A is an amide or an amide-containing group.

74. A lubricant according to claim 73 wherein A is a group of the formula

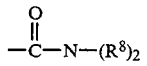

wherein each $R^8$ is independently H. alkoxyalky, hydroxyalkyl or hydrocarbyl.

75. A lubricant according to claim 74 wherein each $R^8$ is independently H lower alkyl.

76. A lubricant according to claim 75 wherein one $R^8$ is H and the other $R^8$ is methyl, ethyl or propyl.

77. A lubricant according to claim 73 wherein A is a group of the formula

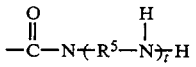

(XII)

wherein $R^5$ is an ethylene, propylene or butylene group and t is a number ranging from 1 to about 4.

78. A lubricant according to claim 73 wherein each R independently contains from 7 to about 28 carbon atoms.

79. A lubricant according to claim 73 wherein each R independently contains an average of at least 30 carbon atoms.

80. A lubricant according to claim 79 wherein each R is derived from polymerized or interpolymerized $C_{2-10}$ olefins.

81. A lubricant according to claim 80 wherein the olefins are selected from the group consisting of propylene, butenes or ethylene.

82. A lubricant according to claim 81 wherein the olefin is propylene and R has a number average molecular weight ranging from 300 to about 2000.

83. A lubricant according to claim 73 wherein each R contains from 7 to about 50 carbon atoms.

84. A lubricant according to claim 73 which further comprises an auxiliary dispersant selected from the group consisting of Mannich dispersants, acylated nitrogen dispersants, ester dispersants, aminophenol dispersants, aminocarbamate dispersants, amine dispersants, alkyl phenols having at least 10 carbon atoms in the alkyl group and imidazolines.

85. A lubricant according to claim 73 which further comprises an auxiliary detergent selected from the group consisting of alkali and alkaline earth overbased sulfonic acids, carboxylic acids or phenols.

86. A lubricant for two-stroke cycle engines comprising a major amount of at least one oil of lubricating viscosity and at least one compound of the formula

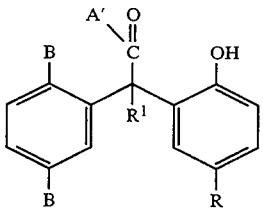

(VII)

wherein $R^1$ is H or an alkyl or alkenyl group containing from 1 to about 20 carbon atoms and each R is independently a hydrocarbyl group containing from 4 to about 300 carbon atoms, and A' is OH or $(OR^5)_bOH$ wherein $R^5$ is a lower alkylene group and b is a number ranging from 0 to about 30, and B is OH or A' and B together are —O— such that the compound comprises a lactone.

87. A lubricant according to claim 86 herein each R independently contains from 7 to about 28 carbon atoms.

88. A lubricant according to claim 86 wherein each R independently contains an average of at least 30 carbon atoms.

89. A lubricant according to claim 88 wherein each R is derived from polymerized or interpolymerized $C_{2-10}$ olefins.

90. A lubricant according to claim 89 wherein the olefins are selected from the group consisting of propylene, butenes or ethylene.

91. A lubricant according to claim 90 wherein the olefin is propylene and R has a number average molecular weight ranging from 300 to about 2000.

92. A lubricant according to claim 86 wherein each R contains from 7 to about 50 carbon atoms.

93. A lubricant according to claim 86 which further comprises an auxiliary dispersant selected from the group consisting of Mannich dispersants, acylated nitrogen dispersants, ester dispersants, aminophenol dispersants, aminocarbamate dispersants, amine dispersants, alkyl phenols having at least 10 carbon atoms in the alkyl group, and imidazolines.

94. A lubricant according to claim 86 which further comprises an auxiliary detergent selected from the group consisting of alkali and alkaline earth overbased sulfonic acids, carboxylic acids or phenols.

95. A lubricant-fuel mixture for two-stroke cycle engines comprising a major amount of a normally liquid fuel and a minor amount of the lubricant of claim 1.

96. A lubricant-fuel mixture for two-stroke cycle engines comprising a major amount of a normally liquid fuel and a minor amount of the lubricant of claim 20.

97. A lubricant-fuel mixture for two-stroke cycle engines comprising a major amount of a normally liquid fuel and a minor amount of the lubricant of claim 46.

98. A lubricant-fuel mixture for two-stroke cycle engines comprising a major amount of a normally liquid fuel and a minor amount of the lubricant of claim 64.

99. A mixture according to claim 95 wherein the fuel comprises gasoline.

100. A mixture according to claim 95 wherein the fuel comprises alcohol.

101. A mixture according to claim 95 wherein the fuel comprises a mixture of gasoline and ethanol.

102. A mixture according to claim 95 wherein the oil of lubricating viscosity comprises mineral oil.

103. A mixture according to claim 95 wherein the oil of lubricating viscosity comprises at least one synthetic oil.

104. A mixture according to claim 95 wherein the oil of lubricating viscosity comprises a vegetable oil.

105. A method of operating a two-stroke cycle internal combustion engine comprising fueling said engine with a mixture according to claim 95.

106. A method of operating a two-stroke cycle internal combustion engine comprising fueling said engine with a mixture according to claim 96.

107. A method of operating a two-stroke cycle internal combustion engine comprising lubricating said engine by introducing into the fuel intake system a lubricant according to claim 1.

108. A method of operating a two-stroke cycle internal combustion engine comprising lubricating said engine by introducing into the fuel intake system a lubricant according to claim 20.

109. An additive concentrate for preparing two-stroke cycle engine lubricants comprising from about 20 to about 90 percent by weight of a substantially inert diluent and from about 10 to about 80% by weight of at least one carboxylic amide composition prepared by reacting an intermediate formed by reacting (a) at least one reactant of the formula

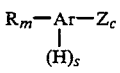

(I)

wherein R is a hydrocarbyl group, m ranges from 0 to about 6, Ar is an aromatic group containing from 5 to about 30 carbon atoms and having from 0 to 3 optional substituents selected from the group consisting of polyalkoxyalkyl, lower alkoxy, nitro, or combinations of two or more of said optional substituents, wherein s is a number of at least 1, each Z is independently OH or $(OR^4)_bOH$, wherein $R^4$ is independently a divalent hydrocarbyl group and b is a number ranging from 1 to about 30 and c is a number ranging from 1 to about 3, wherein the sum s+m+c does not exceed the number of valences of Ar available for substitution, with (b) a carboxylic reactant of the formula

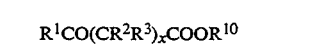

wherein each of $R^1$, $R^2$ and $R^3$ is independently H or a hydrocarbyl group, $R^{10}$ is H or an alkyl group and x is a number ranging from 0 to about 8; and optionally, (c) ammonia or an amine having at least one N—H group.

110. An additive concentrate for preparing 2-stroke cycle engine lubricants comprising from about 20 to about 90 percent by weight of a substantially inert diluent and from about 10 to about 80 percent by weight of at least one carboxylic composition of the general formula

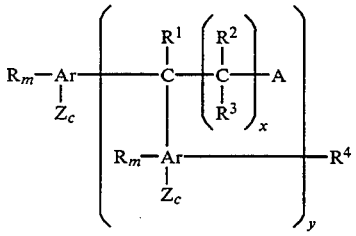

(III)

wherein each Ar is independently an aromatic group having from 5 to about 30 carbon atoms and from about 0 to 3 optional substituents selected from the group consisting of amino, hydroxy- or alkylpolyoxyalkyl, nitro, aminoalkyl, carboxy, or combinations of two or more of said optional substituents, each R is independently a hydrocarbyl group, $R^1$ is H or a hydrocarbyl group, $R^4$ is selected from the group consisting of H, a hydrocarbyl group, a member of the group of optional substituents on At, or lower alkoxy, each m is independently 0 or an integer ranging from 1 to about 6, x ranges from 0 to about 8, and each Z is independently OH, lower alkoxy or $(OR^5)_bOR^6$, wherein each $R^5$ is independently a divalent hydrocarbyl group, $R^6$ is H or hydrocarbyl and b is a number ranging from 1 to about 30, and c ranges from 1 to about 3, y is a number ranging from 1 to about 10 and wherein the sum m+c does not exceed the number of valences of the corresponding Ar available for substitution, and each A is independently an amide or an amide-containing group, a carboxyl group, a group of the formula

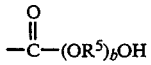

wherein each $R^5$ is independently a divalent hydrocarbyl group and b is a number ranging from 1 to about 30, an imidazoline-containing group, an oxazoline group, an ester group, an acylamino group or one Z and one A are taken together, make up a group of the formula

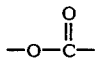

to form a lactone group of the formula

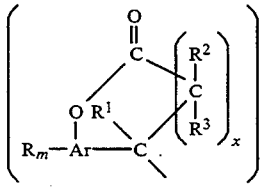

(IV)

or mixtures thereof.

* * * * *